US011708255B2

(12) United States Patent
Bunster

(10) Patent No.: US 11,708,255 B2
(45) Date of Patent: Jul. 25, 2023

(54) CORK REMOVER AND EJECTOR

(71) Applicant: Alvaro Bunster, San Luis de Sabinillas (ES)

(72) Inventor: Alvaro Bunster, San Luis de Sabinillas (ES)

( * ) Notice: Subject to any disclaimer, the term of this patent is extended or adjusted under 35 U.S.C. 154(b) by 249 days.

(21) Appl. No.: 17/009,819

(22) Filed: Sep. 2, 2020

(65) Prior Publication Data

US 2022/0063977 A1 Mar. 3, 2022

(51) Int. Cl.
*B67B 7/04* (2006.01)

(52) U.S. Cl.
CPC ..... *B67B 7/0405* (2013.01)

(58) Field of Classification Search
CPC ..... B67B 7/0405; B67B 7/04–2007/0494
USPC ..... 81/3.08, 3.09, 3.35, 3.36, 3.4
See application file for complete search history.

(56) References Cited

U.S. PATENT DOCUMENTS 986,855 A * 3/1911 Peck ..... B67B 7/0441 81/3.35
2018/0050895 A1* 2/2018 Liu ..... B67B 7/0405

* cited by examiner

*Primary Examiner* — Thomas Raymond Rodgers

(57) ABSTRACT

The present invention is a cork removal tool and cork ejector. The big effort required is reduced by incorporating a battery powered reversible DC electric motor. It allows the extraction of the cork from a bottle and its ejection from the tool with a single hand, with minimal effort on the part of the user, holding the cork remover and bottle together to open the bottle and only the opener itself to eject the cork from the latter. Binding of the opener is avoided by a ratcheted nut assembly which in conjunction with a micro switch protects the opener from binding due to a wrongly pressed switch and allows the screw to penetrate the cork and to remove it from the bottle and then from the opener smoothly. The single hand operation enables operators who only have use of one hand to open a bottle of wine.

8 Claims, 23 Drawing Sheets

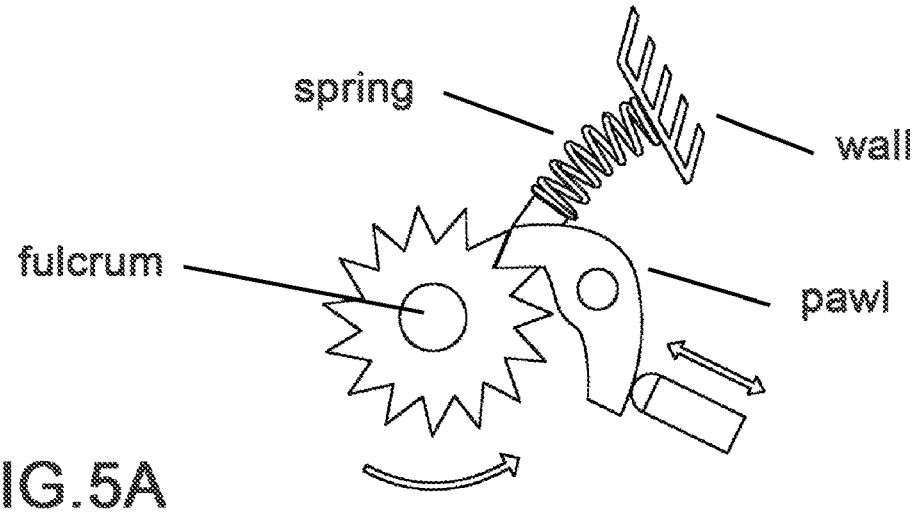
FIG.5A
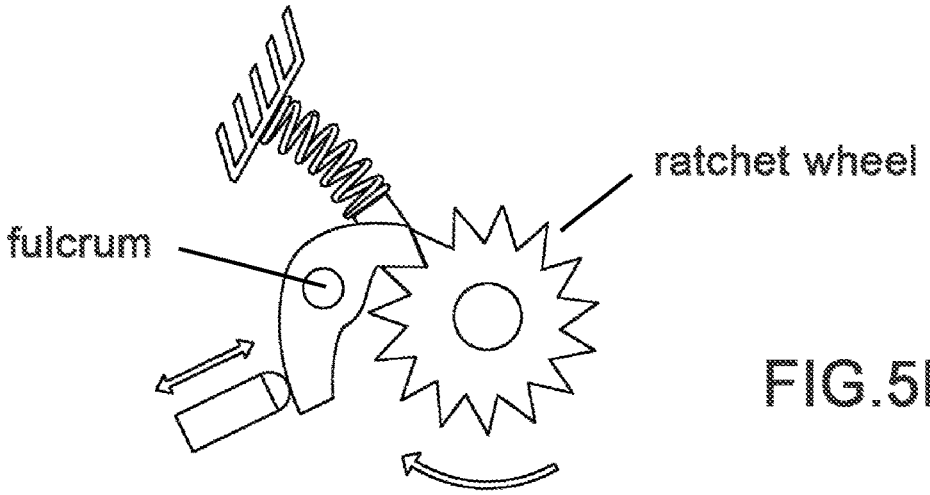
FIG.5B
FIG.5C
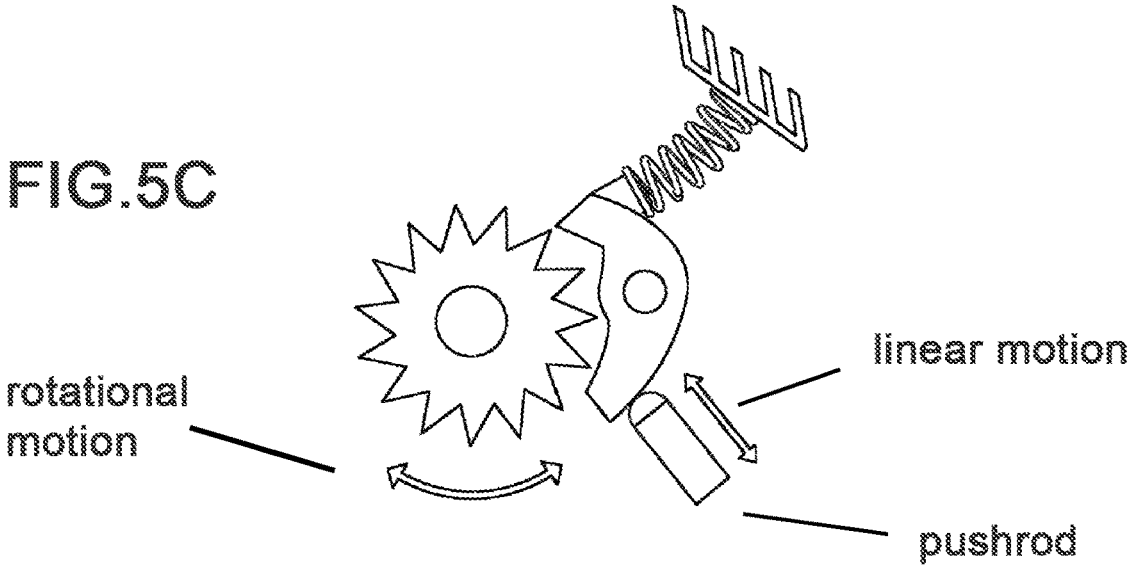

CORK REMOVER AND EJECTOR

CROSS REFERENCE TO RELATED APPLICATIONS

Not Applicable

STATEMENT REGARDING FEDERALLY SPONSORED RESEARCH OR DEVELOPMENT (IF APPLICABLE)

Not Applicable

REFERENCE TO A SEQUENCE LISTING, A TABLE, OR A COMPUTER PROGRAM LISTING COMPACT DISK APPENDIX (IF APPLICABLE)

Not Applicable

BACKGROUND OF THE INVENTION

This invention pertains to the removal of a cork from wine bottles and the subsequent ejection of the cork from the cork remover and ejector or opener electrically. The problems associated with this task are the considerable force required to pull the cork out of the bottle, the binding of the electric opener, and the use of more than one hand. The opener in question falls under the general classification of a nut corkscrew where the retraction of the opener, the initial penetration of the screw into the cork, and the subsequent linear travel of the screw is ensured by the interaction of a screw and nut. The nut also enables the opener to extend itself in the cork ejection operation and the cork to be expelled smoothly from the opener by the continued rotation of the screw in the opposite direction without it interfering in the process. The extraction and ejection is done electrically thus reducing the human force required to pull the cork out of the bottle. The pulling force required to remove the cork from the bottle and the pushing force required to eject the cork from the opener is generated by the rotation of the screw and is not directly produced by the user. U.S. Pat. Nos. 10,196,251 and 4,637,283 mention a gearbox and electrical operation to provide high torque to the corkscrew and thus provide the high axial forces required and at the same time reduce the effort on the part of the user to carry out the extraction and ejection. Additionally the ratchets in the nut prevent the opener from binding when it reaches its end of travel. Binding of the opener due to the presence of the cork is further avoided by a micro switch in analogous fashion to U.S. Pat. No. 6,752,041 which incorporates a control switch to cut power to the corkscrew when the cork reaches a certain position.

The entire operation of the opener requires little effort on the part of the user who single handed is required to press a switch and to hold the bottle and opener together by the handles built in to the opener. The single hand operation is addressed in U.S. Pat. No. 7,614,323.

BRIEF SUMMARY OF THE INVENTION

The present invention is a cork removal and ejector tool primarily for wine bottles. It is also referred to as the opener or extractor. The extractor in question allows the extraction of the cork from the bottle and its ejection from the opener with a single hand, and no binding of the opener, with minimal effort on the part of the user, due to electric power and the design of the apparatus, holding the cork remover and the bottle together at the same time to open the bottle and only the opener itself to extract the cork from the latter. The opener is powered by a reversible DC (Direct Current) electric motor fed by batteries which together with a speed reduction gearbox minimizes the effort required by the user. The tool is telescopic in nature incorporating telescopic and stationary bodies which move relative to each other. The latter includes a nut assembly where the nut in addition to its inner thread has two ratches built around its body that work in opposite directions and are coaxial with the corkscrew and the splines on the stationary body. Additionally it features a micro switch. The splines, nut, corkscrew; micro switch and cork interact with each other. This interaction allows the cork to be removed from the bottle and then from the opener efficiently. Binding of the cork remover is avoided by the operation of the two ratchets and the micro switch where the latter protects the opener from binding due to a wrongly pressed on/off switch. The single hand operation enables operators who only have use of one hand to open a bottle of wine. Thus the opener allows the removal of the cork from the bottle and the subsequent ejection of the latter from the opener, while preventing binding of the opener, all with minimal effort by the user and with a single hand.

BRIEF DESCRIPTION AND SEVERAL VIEWS OF THE DRAWING

FIG. 5A, FIG. 5B and FIG. 5C illustrate the ratchet mechanism.

DETAILED DESCRIPTION OF THE INVENTION

Figure 1:
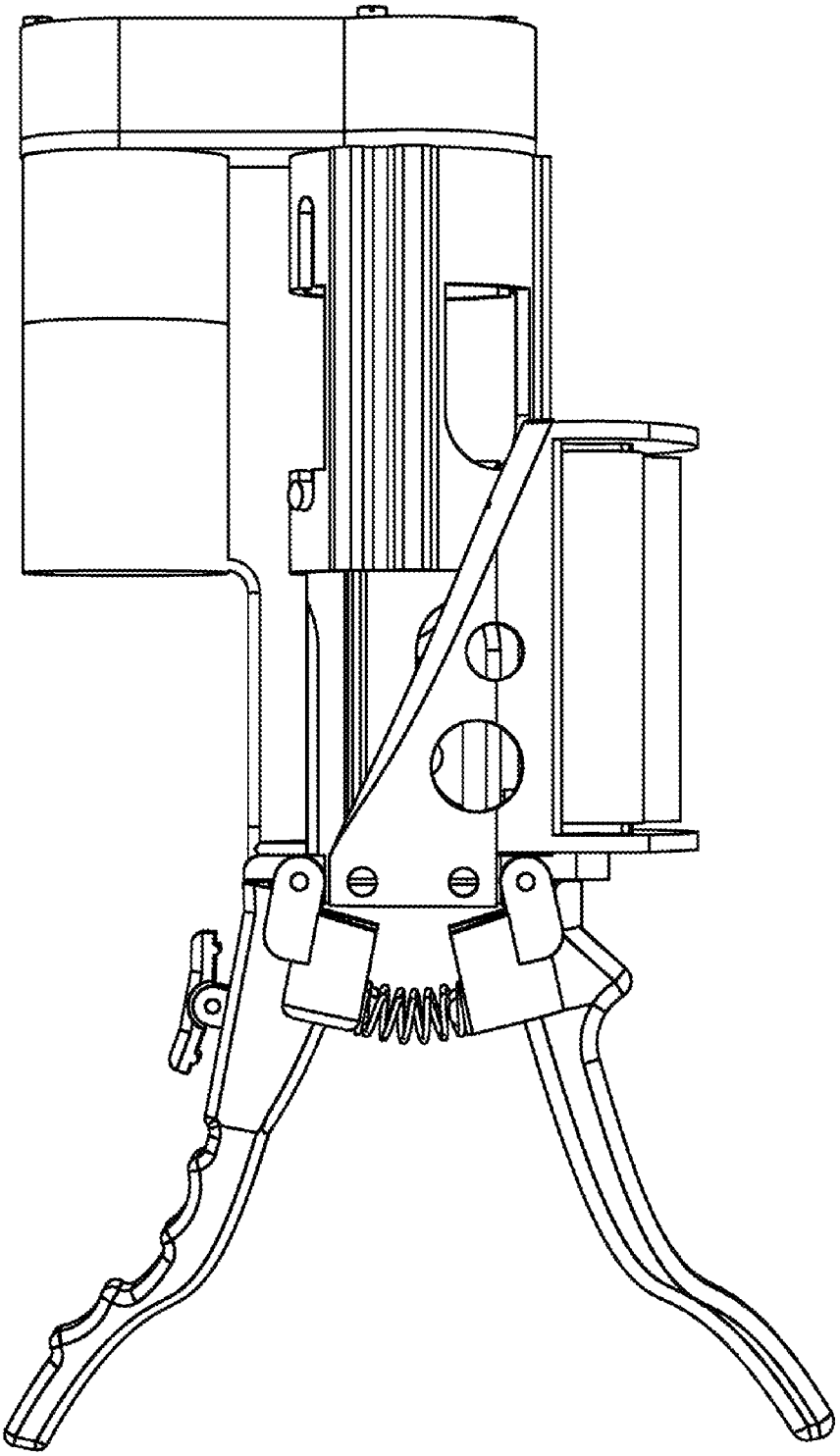
FIG. 1 shows the parallel embodiment of the opener in its extended position.

There follows a general description of invention. In subsequent sections individual embodiments making up the opener are described more comprehensively with reference to figures.

The wine bottle cork remover and ejector or opener or cork extractor essentially consists of two telescoping bodies A and B which slide over one another. See FIG. 1 to FIG. 4 to get a good idea of the remover/ejector. Body A, the top body, slips over body B and is movable up and down, whereas the latter is stationary relative to the bottle in the vertical axis as it sits over the bottle and only the handles move—they squeeze together as they grip the bottle and move apart as they release the bottle. Hence forth they are referred to as bodies A and B.

Body A incorporates the tele body which comprises 3 guide channels that slide over three corresponding guide rails in body B allowing relative motion of the two bodies only in an axial direction and keeping the two bodies aligned, and two actuating channels channel1 and channel2. The latter have ramps that displace the pushrods incorporated in the nut assembly when body A is at either end of its travel thus engaging or disengaging the corresponding pawl with the appropriate ratchet on the nut. Additionally body A incorporates the motor mount, the electric DC/BLDC (DirectCurrent/Brush Less Direct Current) motor, the electric motor reduction gearbox, and the corkscrew together with the transmission, where the latter is the coupling between the gearbox and the cork screw. In the case of the inline embodiment this is achieved by directly connecting the gearbox to the cork screw via a sleeve, whereas in the parallel embodiment of the opener it is achieved by the use of gears and a belt drive.

Body B incorporates the fixed body, which in turn comprises three guide rails that mate with the three guide channels in the tele body, and three sharp splines to hold the cork without the latter rotating while it is extracted from the bottle or ejected from the cork extractor as the cork slides relative to the fixed body; the nut assembly whose main components are the nut itself with two built in ratchets configured in opposite senses and two pawls that engage with the ratchets, a micro switch turning off power to the motor when spinning in a direction bringing the cork and fixed body together, placed on the underside of the nut, the battery housing, batteries, wire harness, two handles, the DPDT (Double Pole Double Throw) switch and PCB (printed circuit board) on one handle, two rubber lined grips which are part of the handle structures and grab the bottle itself, and the two springs which keep the two grips normally apart. The fixed body has the bottom mouth shaped circularly such that it mates with the wine bottle with integrity and keeps the opener and bottle inline so the opening operation can be carried out smoothly. The batteries, PCB, switch, micro switch and motor are interconnected with flexible wire which constitutes the wire harness.

Note that there are two embodiments contemplated for the opener: the preferred embodiment where the motor, gearbox and associated components are parallel to the rest of the telescoping body with a belt transmission to the corkscrew, and the inline embodiment where all components of the telescoping body are inline. The former has the advantage of making the whole opener have a more compact profile by making it shorter but also wider and have a lower center of gravity, which makes it more manageable. The latter is simpler in design and requires fewer parts. They perform the same function.

INDEX OF PARTS

Figure 2:
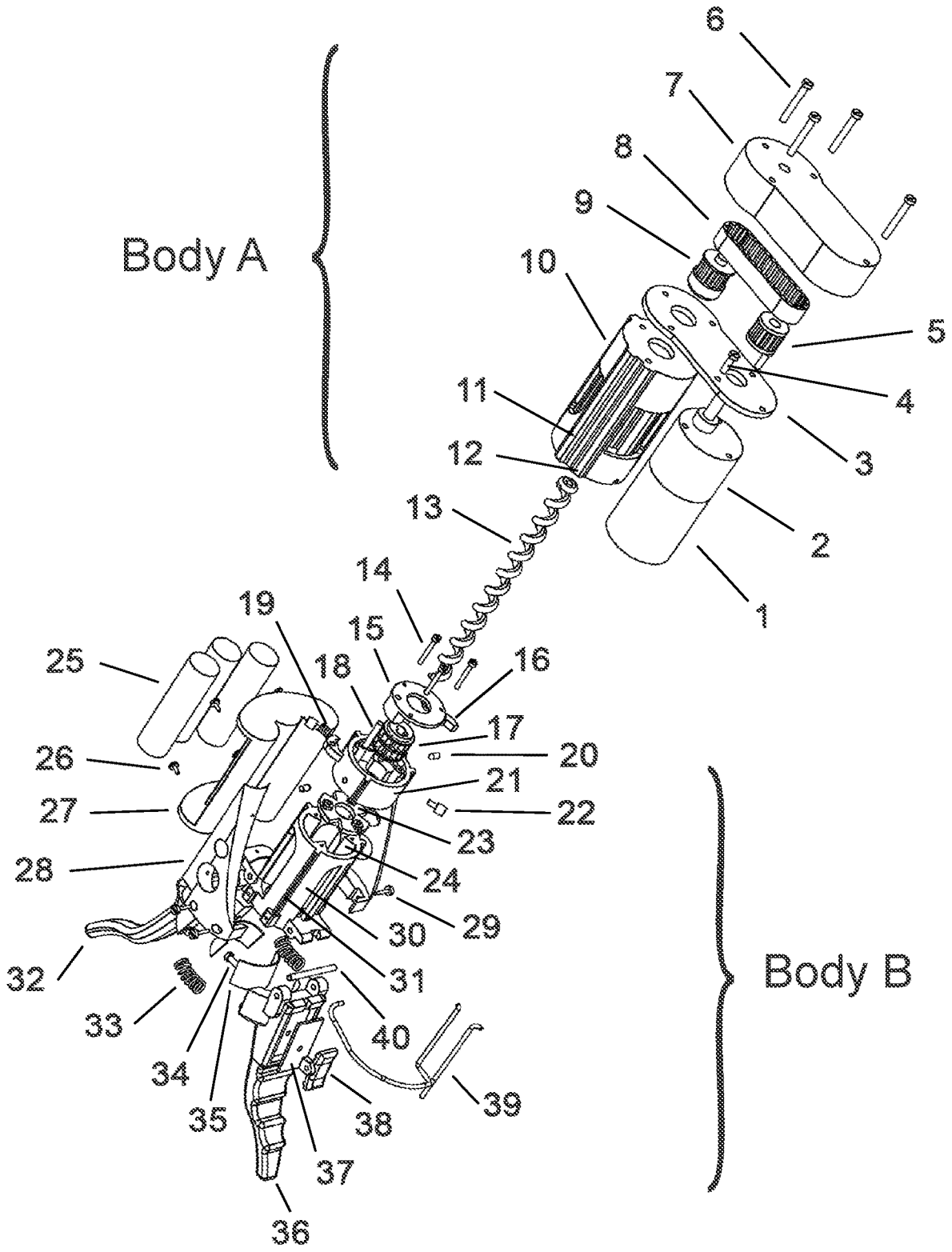
FIG. 2 is an exploded view of the parallel embodiment of the opener with parts numbering.
Figure 3:
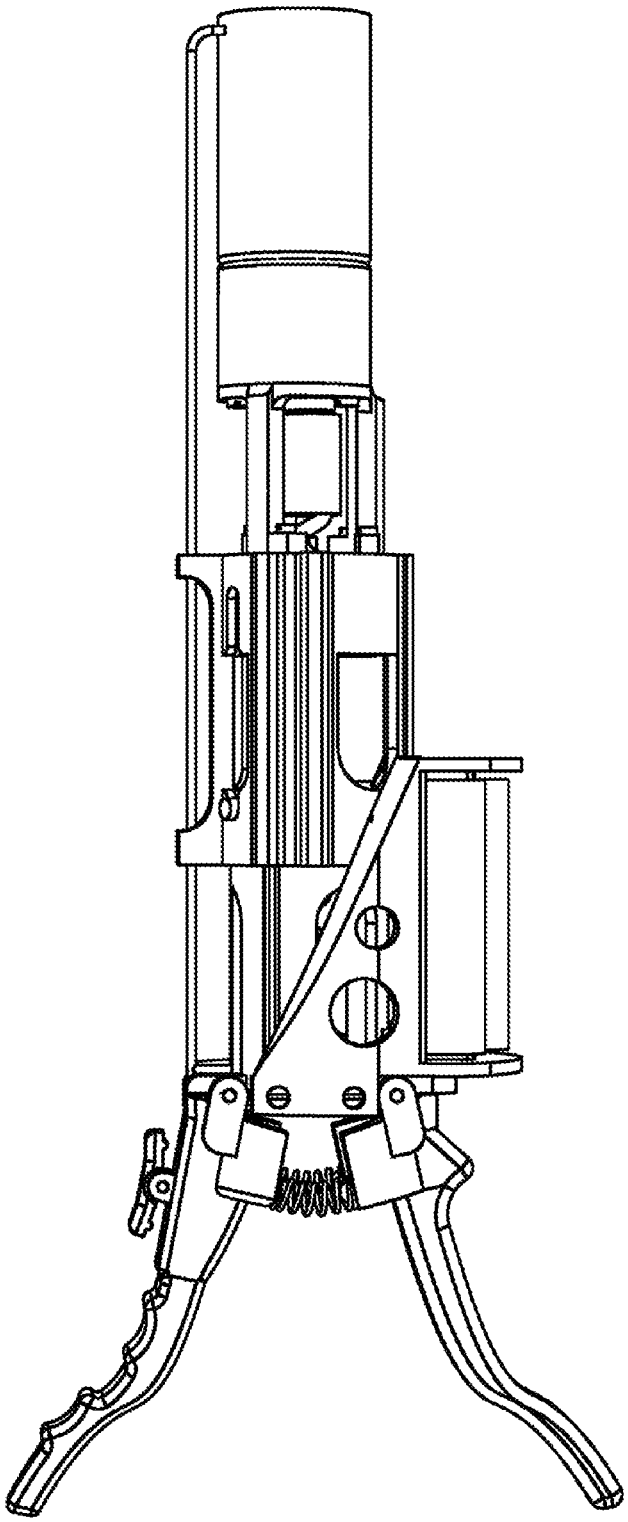
FIG. 3 shows the opener in its alternate inline embodiment in its extended position.
Figure 4:
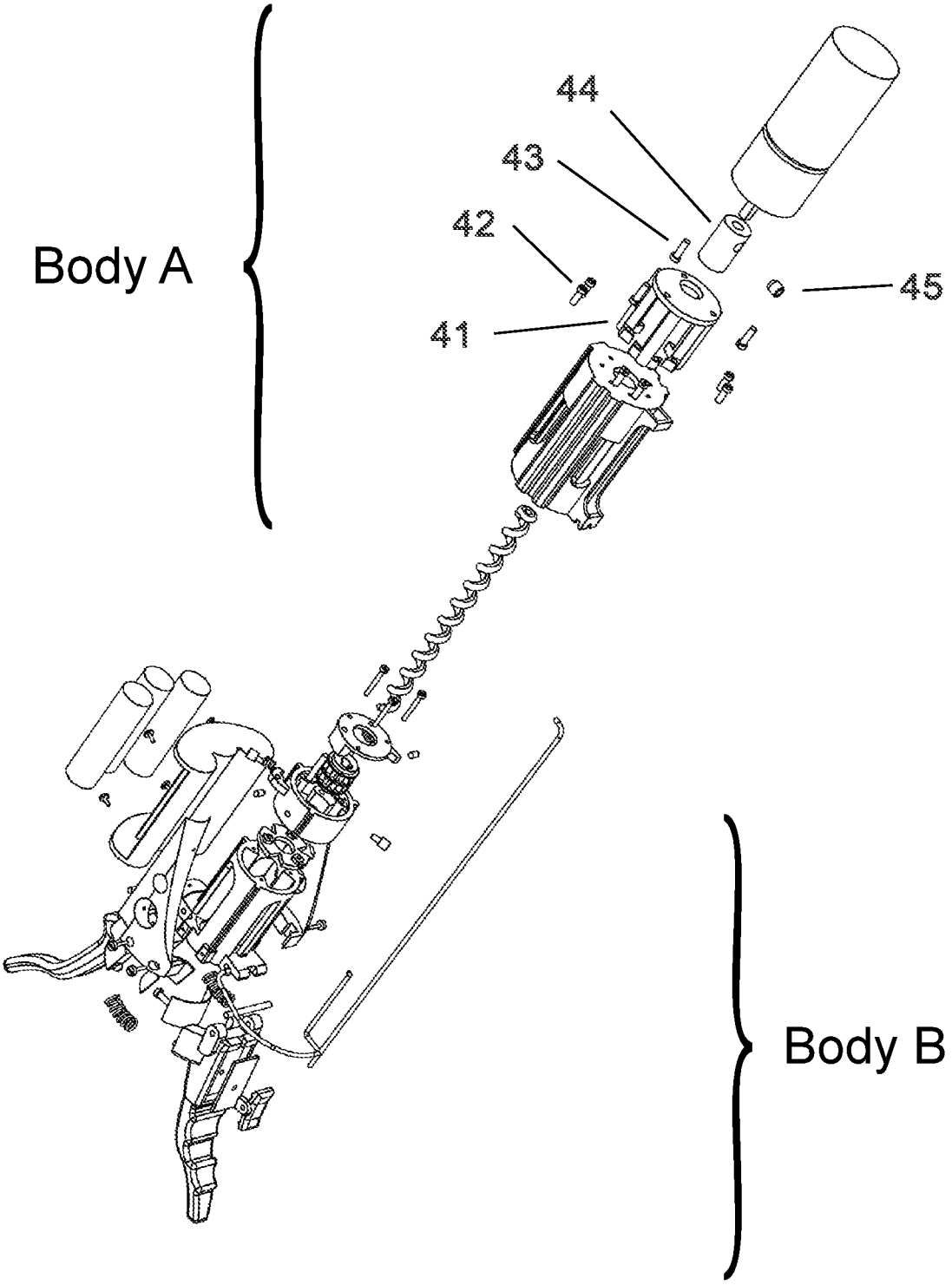
FIG. 4 is an exploded view of the alternate inline embodiment of the opener with additional/alternate parts numbering.

In the parallel embodiment of the opener FIG. 1 and FIG. 2, the parts making up the opener are as outlined below:

Body A, the telescopic body, incorporates the following parts and assemblies:

1—Motor
2—Gearbox
3—Motor mount or plate
4—Motor screws, three of
5—Gearbox gear
6—Cover screws, three of
7—Cover
8—Belt
9—Corkscrew Gear
10—Tele body
11—Actuation channels
12—Guide channels
13—Corkscrew Body B, the stationary body (only in the axial sense since the handles move to grip the bottle) incorporates the following parts and assemblies:

14—Lid-Housing-Fixed body screws, three of
15—Lid
16—Pawls, two of
17—Nut
18—Pawl pins, two of
19—Pawl springs, two of
20—Pushrods, two of
21—Housing
22—Stops, two of
23—Micro switch
24—Sharp splines, three of
25—Batteries, three of
26—Battery Holder screws, four of
27—Battery Holder
28—Supports, two of
29—Support screws, four of
30—Fixed body
31—Guide rails, three of
32—Left handle with bottle grip built in
33—Handle Spring, two of
34—PCB screw
35—Rubber Linings, two of
36—Right Handle with bottle grip and switch built in
37—PCB
38—Switch
39—Wire harness
40—Handle pin, two of In the inline embodiment of the opener FIG. 3 and FIG. 4, body A incorporates the following additional/alternate parts and assemblies:

41—Motor chassis
42—Chassis screw, six of
43—Motor screws, three of
44—Coupling
45—Set screw

Ratchet Mechanism

FIG. 5A, FIG. 5B and FIG. 5C show a typical ratchet mechanism having a single ratchet wheel. The mechanism consists of the ratchet wheel with saw tooth shaped teeth, the pawl, the pushrod, the spring and associated support structures like the wall and the fulcrums, where the latter are attained by means of pins. The fulcrums allow the ratchet wheel and pawl to rotate about them. The three figures illustrate three scenarios. FIG. 5A shows a right hand ratchet with pawl engaged and the wheel is free to rotate only in the counter clockwise direction. It cannot rotate in the clockwise direction. FIG. 5B shows a left hand ratchet with pawl engaged and the wheel is free to rotate only in the clockwise direction. It cannot rotate in the counter clockwise direction. Thus when the pawl is engaged the ratchet or wheel can only rotate in one direction. In this case the rotation is with a clicking sound which arises when the engaged pawl drags over the surface of the teeth in the ratchet wheel and suddenly drops to the base of the teeth. FIG. 5C shows a right hand ratchet with pawl disengaged resulting in the wheel being free to rotate in the clockwise and counter clockwise direction with no clicking sound.

Nut Assembly

Figure 6A:
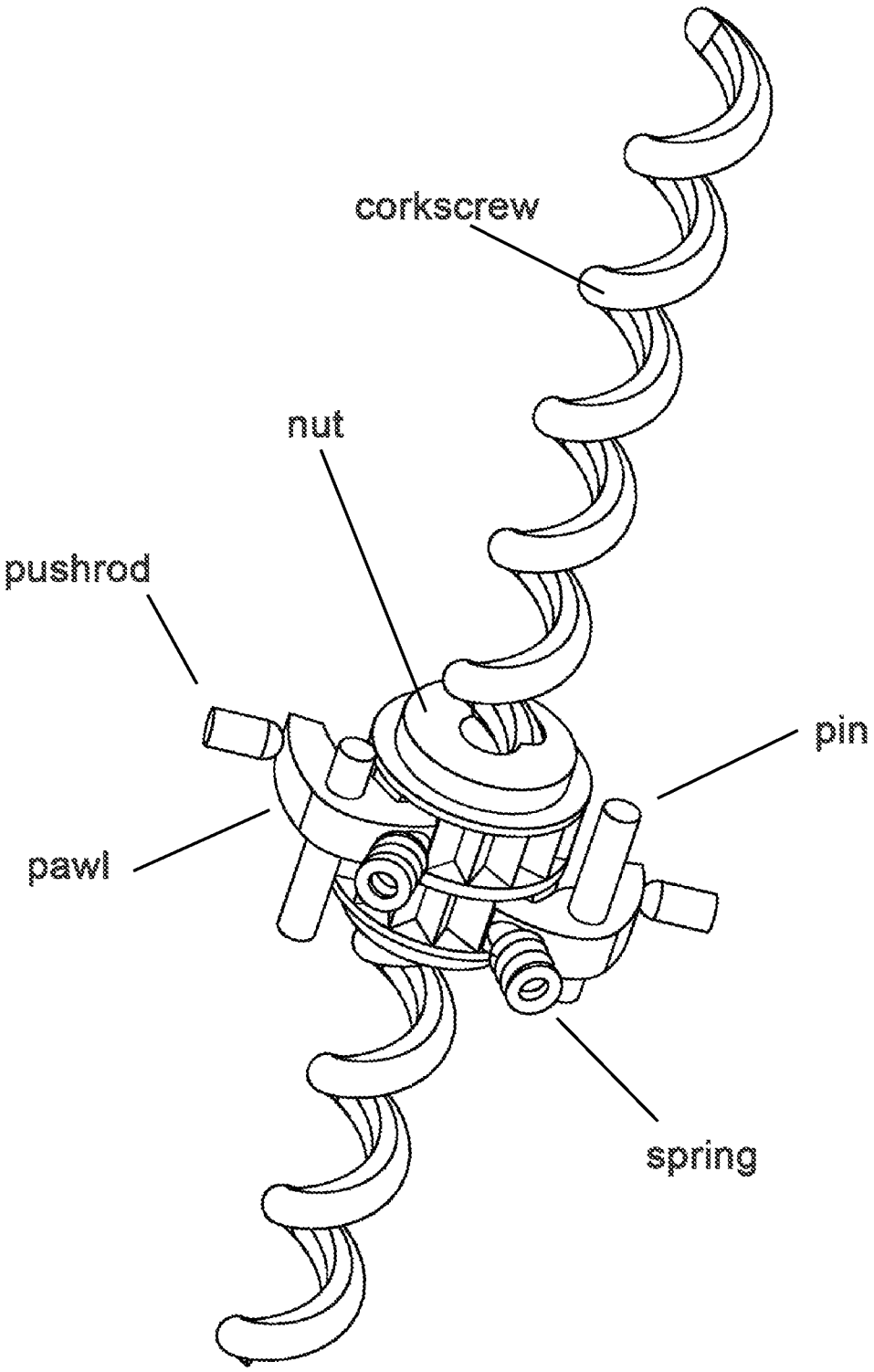
FIG. 6A, FIG. 6B and FIG. 6C represent views of the nut with associated components and the interaction with the corkscrew.
Figure 6B:
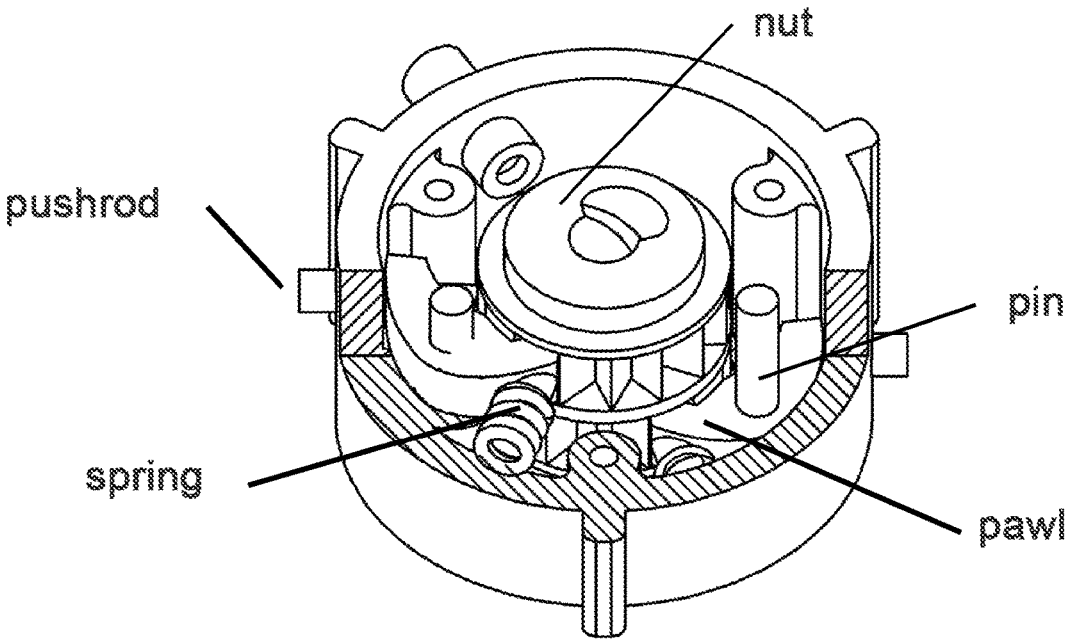
Figure 6C:
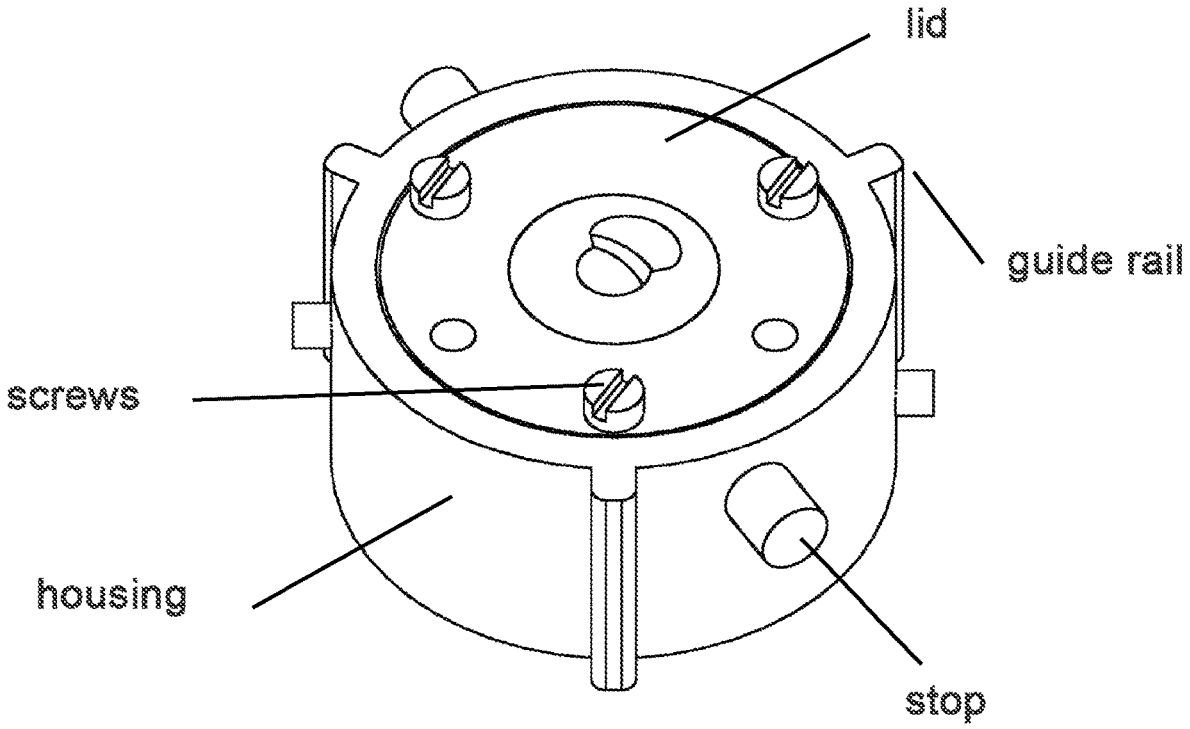

The nut assembly is incorporated in stationary body B and consists of the nut housing with lid and screws, two stops so that bodies A and B don't come apart, the nut with two built in ratchets arranged in opposite directions which govern the rotation of the nut, its associated pawls which engage with the ratchets, pawl1 and pawl2, the pawl springs that make the pawls return to their fully engaged position when the pushrods allow, the pawl pins which hold the pawls and allow them to rotate about them, and the two pawl pushrods which push on the pawls to make the latter disengage the ratchets. FIG. 6A, FIG. 6B and FIG. 6C show the main components of the nut assembly. The interaction of the nut and associated components with the cork screw is displayed in FIG. 6A, while the nut assembly is seen in FIG. 6B and FIG. 6C. Note that in FIG. 6B a cut-out has been made to the housing to enable a clearer view. The nut itself incorporates two ratchet units, butted together and arranged in opposite directions with one placed on top of the other, as depicted in FIG. 6A. The right hand ratchet is on top whereas the left hand ratchet is at the bottom. These consist of 24 teeth (this number could vary) so that each tooth represents 15 degrees of rotation. It has a clockwise right hand side internal thread in its center, as viewed from above, to match that of the corkscrew which screws into the center of the nut and has a pitch of about 1 turn every 3 mm of longitude. The pushrods ride on a cylindrical orifice of the housing and one end is normally flush with the outermost wall (bottom of channel) of the channels in the tele body—relative to the center of the opener—when the extractor is in an intermediate position, or with the innermost wall (top) of the channels or ramps when the extractor is in a fully extended or retracted position. The other end is of course flush with the face of its corresponding pawl. The ratcheted nut is the heart of the operation of the cork remover and ejector. It allows for an axial force required for cork extraction and ejection while it allows bodies A and B to move telescopically relative to each other and prevents them from binding during operation. By binding in this context it is meant a lack of relative motion between these two bodies while the force tending to cause it is present. It leads to the electric motor stalling and unnecessary drain of the batteries. In this case binding can occur when the stationary and the fixed bodies cannot move relative to each other in a given direction. Additionally binding will happen when the cork and fixed body cannot come any closer. The former case is prevented by the nut mechanism which allows the nut and the corkscrew to continue turning in unison, thereby performing the desired operation, and the motor not to stall, even though the opener is fully retracted or fully extended and the switch is pressed as if the two bodies were still coming together. The latter case is prevented by a micro switch which senses when the cork has reached its uppermost position inside the fixed body and turns off power to the motor so that it cannot continue to bring the cork and the fixed body together. In this case rotation of the motor in the opposite direction is still allowed.

The ratchet mechanism operates as follows: upper Pawl1 engages or disengages ratchet1 whereas lower Pawl2 engages or disengages ratchet2. By engagement it is meant that the pawl is not lifted away from the nut and makes direct contact with a tooth in its corresponding ratchet which prevents rotation of the nut towards the said pawl thus locking it in a given direction. Disengagement occurs when the pawl is lifted away from the ratchet by the action of the pushrod which results in the ability of the nut to rotate towards the said pawl. FIG. 6A shows pawl1 and pawl2 in the engaged position. A characteristic of a single ratchet mechanism when the pawl is engaged is that while the ratchet cannot rotate towards the pawl, it is able to do so in the opposite direction because the pawl can skip the teeth of the ratchet, making a clicking sound as it does so. The two pairs of pawls and ratchets are arranged in opposing directions. When the pawls are both disengaged the nut can rotate freely in either direction. The pawls can never both be disengaged at the same time (see states of pawl-ratchet mechanism below). When only one of the pawls is disengaged, at the extreme positions of the extractor, the nut can rotate only in one direction, and if so it rotates in the same sense as the corkscrew: this rotation is counter clockwise when the opener is fully extended and clockwise when it is fully retracted, albeit with the clicking sound which arises when the engaged pawl drags over the surface of the ratchet. In this fashion binding is prevented. In the intermediate position when both pawls are engaged the nut cannot rotate at all relative to the corkscrew.

The nut therefore has three states:

1) The opener is fully extended, and the nut cannot rotate in the clockwise direction because ratchet1 is fully engaged by pawl1. Pawl2 on the other hand is fully disengaged permitting the nut to rotate in the counter clockwise direction.

2) The opener is fully retracted, and the nut can only rotate in the clockwise direction because ratchet1 is fully disengaged by pawl1. Pawl2 on the other hand is fully engaged not permitting the nut to rotate in the counter clockwise direction.

3) The opener is in an intermediate position between a fully extended and a fully retracted position where the nut cannot rotate freely in either direction.

Actuation Ramps on Telescopic Body

Figure 7A:
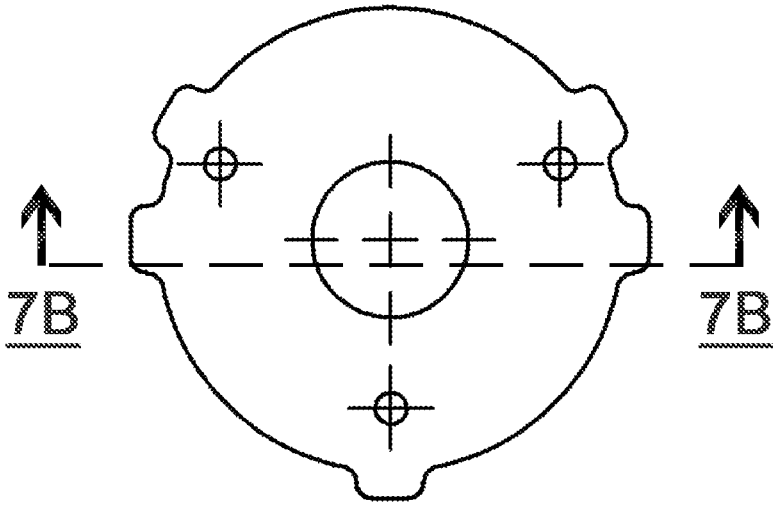
FIG. 7A and FIG. 7B show a section view of the tele body.
Figure 7B:
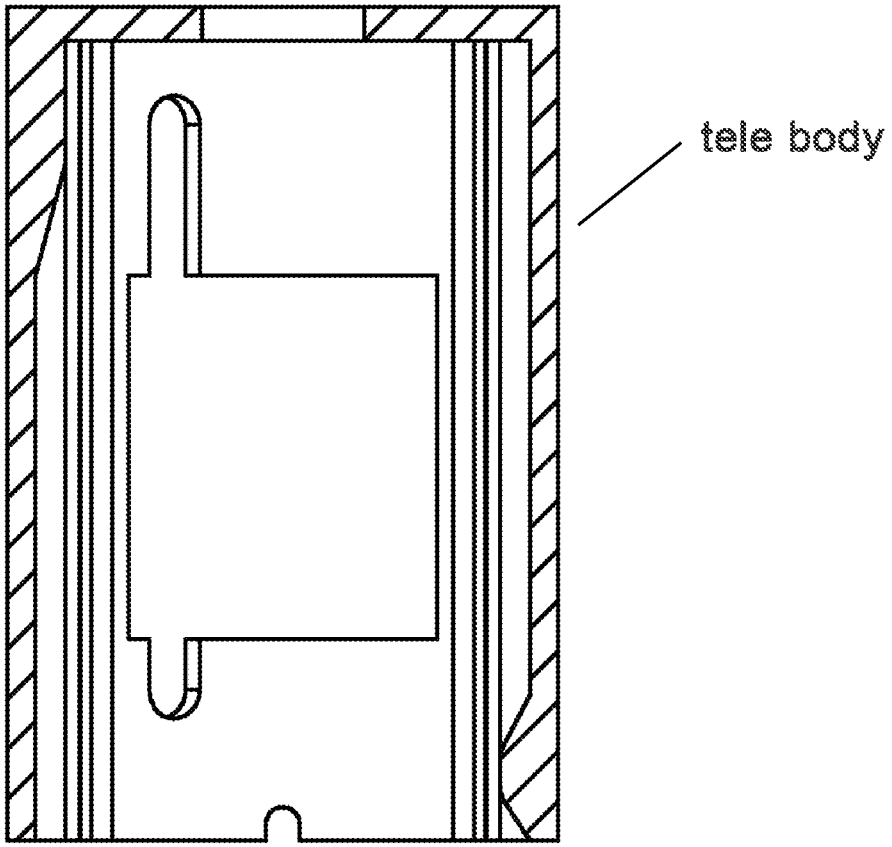
Figure 7C:
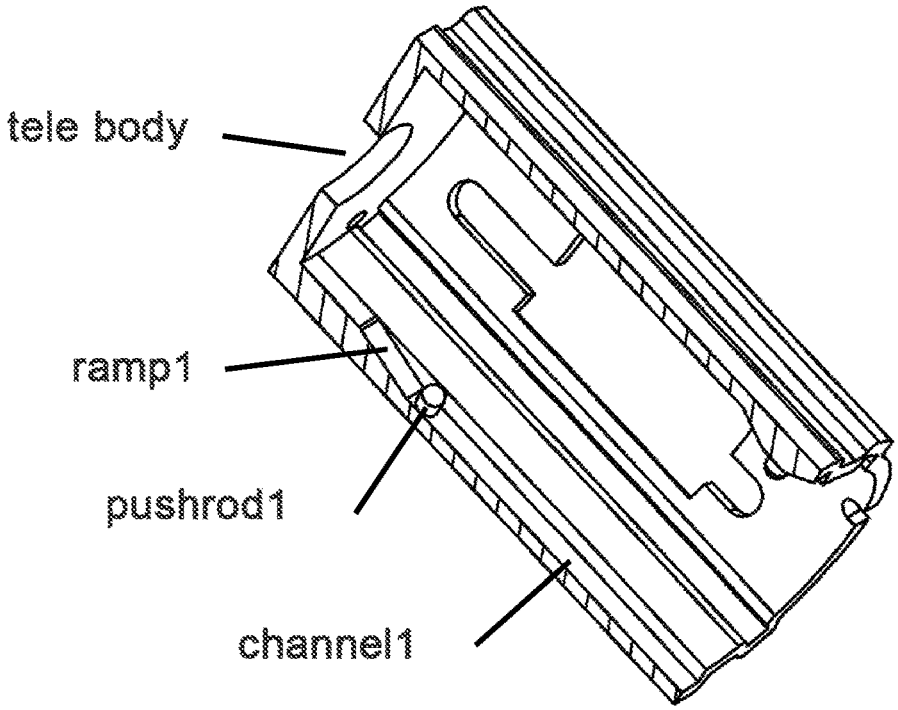
FIG. 7C and FIG. 7D show isometric views of the interaction of the pushrods with the ramps and actuation channels built into the tele body as well as the tele body itself for the case of upper and lower pawls respectively.
Figure 7D:
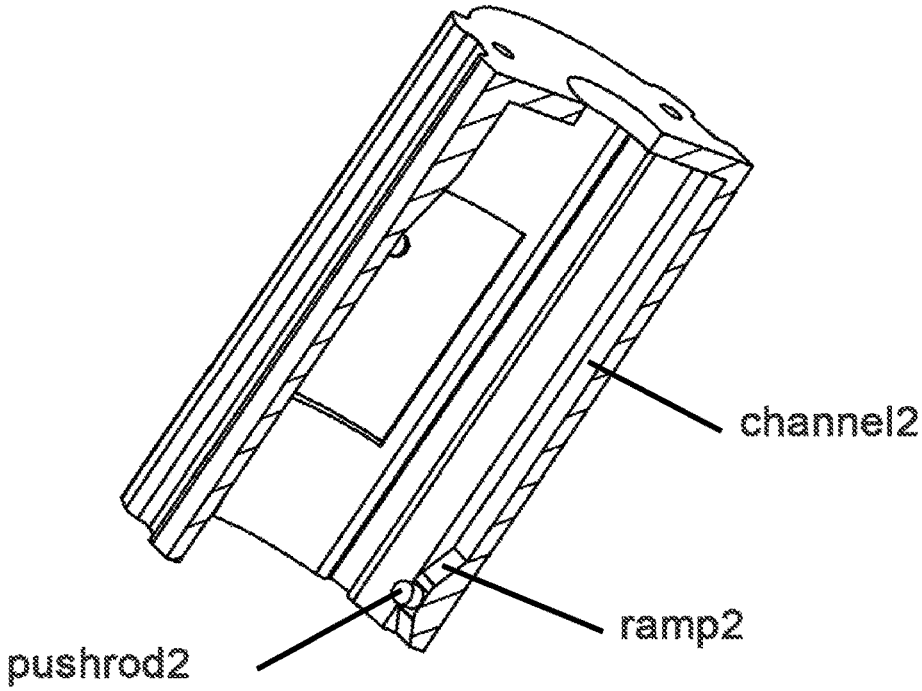

FIG. 7A and FIG. 7B represent a section view of the tele body. FIG. 7C and FIG. 7D are isometric views the tele body sectioned as in FIG. 7A showing the two actuation channels where channel1 features a ramp at the top of the tele body that pushes pawl1 and channel2 which features a ramp at the bottom of the tele body that pushes pawl2. The ramps go from the full depth of the channel to its zero depth in a short distance. These two ramps displace the pushrods incorporated in the nut assembly when body A is at either end of its travel thus disengaging or engaging the corresponding pawls with the nut. Note that FIG. 7C shows the ramp in channel1 together with the uppermost pushrod that actuates pawl1, with the pushrod being in its outermost position, i.e. pawl1 is engaged with its corresponding ratchet. In this situation body A has not quite reached the end of its travel in the downwards direction so that the opener is still not in the retracted state. When the latter is however, the ramp has pushed on the pushrod and caused pawl1 to disengage from the ratchet, allowing the nut to rotate towards pawl1. Similarly FIG. 7D shows the ramp in channel2 together with the lowermost pushrod that actuates pawl2, with the pushrod being in its innermost position, i.e. pawl2 is disengaged from its corresponding ratchet. This happens when the opener is in the fully extended configuration and the nut can turn anti-clockwise towards pawl2. This ramp is double sided because the side of the ramp towards the open end of the tele body is there to make the latter fit over body B at the time of assembly only, and does not play a part during operation of the opener.

Splines on Fixed Body

Figure 8A:
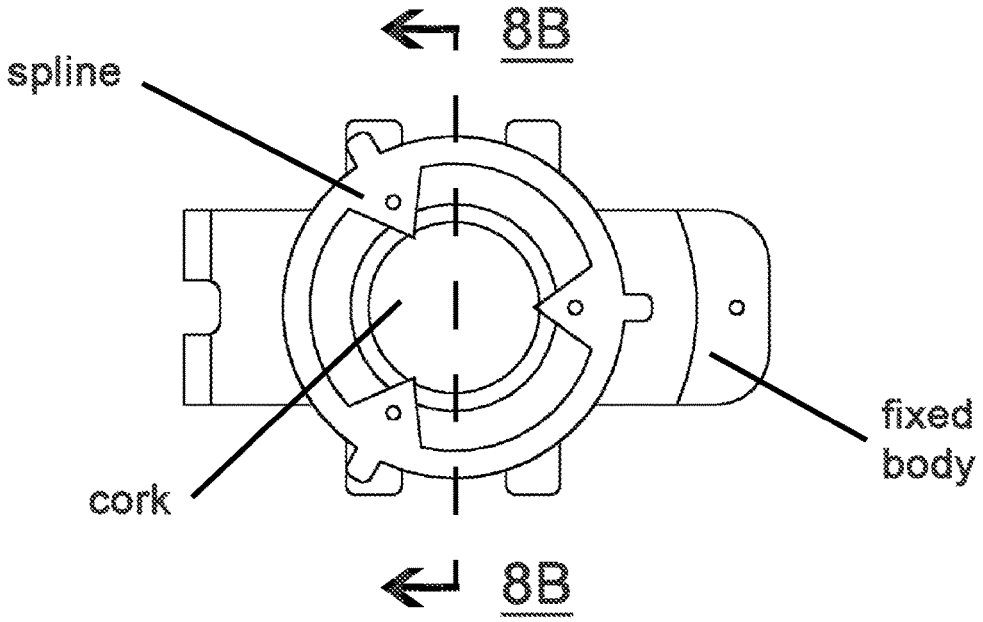
FIG. 8A and FIG. 8B show the interaction of the splines and the cork in the fixed body
Figure 8B:
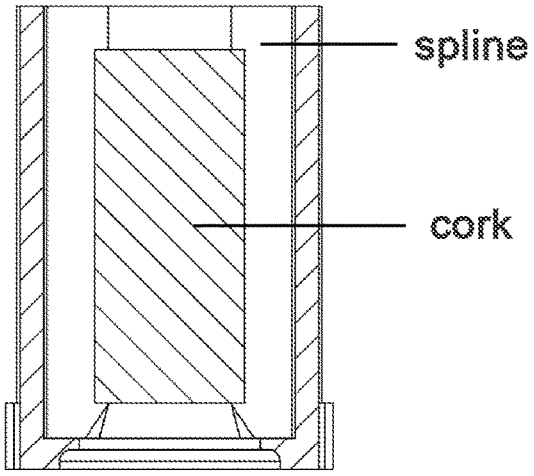
Figure 8C:
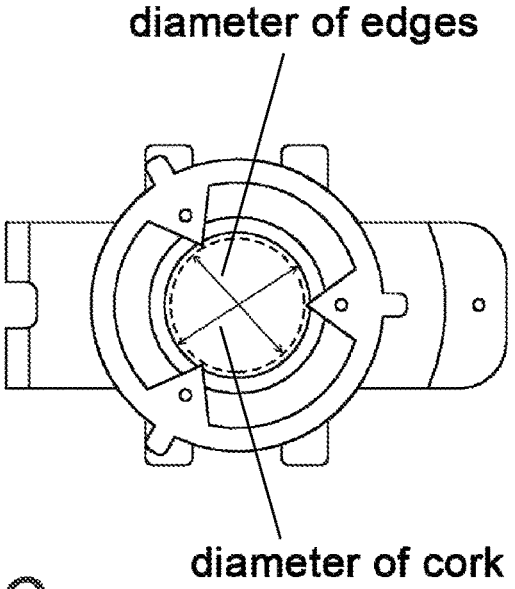
FIG. 8C shows how the diameter of the location of the edges of the splines is smaller than the diameter of the cork.

FIG. 8A, FIG. 8B and FIG. 8C represent with the help of a section view the interaction of the cork and the splines. The splines are arranged as three units 120 degrees apart with the inner sharp edges of the splines having a location diameter slightly less than the diameter of the cork. The sharp edges therefore grab the cork and prevent it from rotating while still allowing it to move along the splines. Thus they allow the screw to perform its function of screwing in and out the cork while at the same time displacing it only axially.

Handles on Fixed Body

Figure 9A:
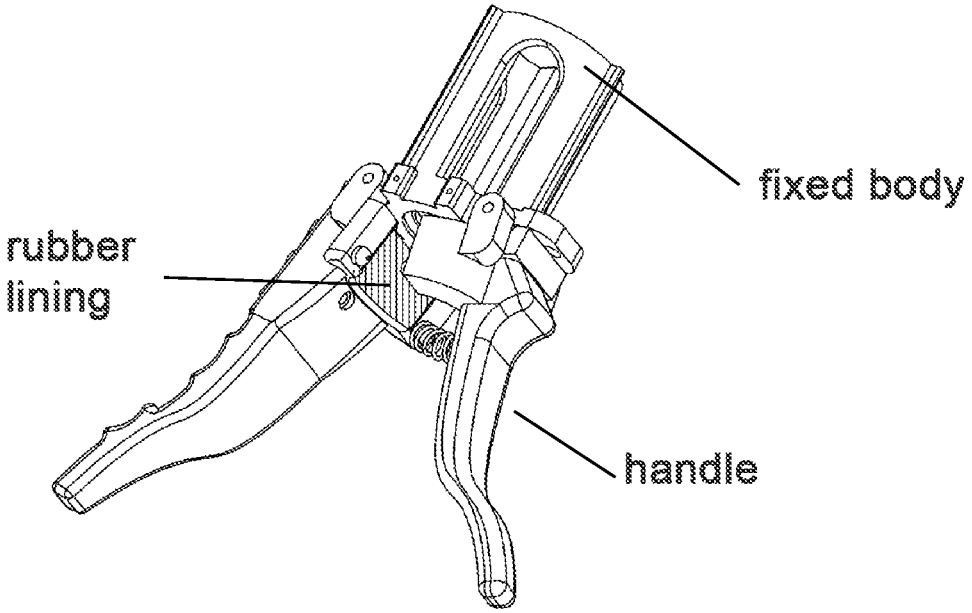
FIG. 9A shows the handles, their attachment to the fixed body, the grips and the rubber lining on the grips.
Figure 9B:
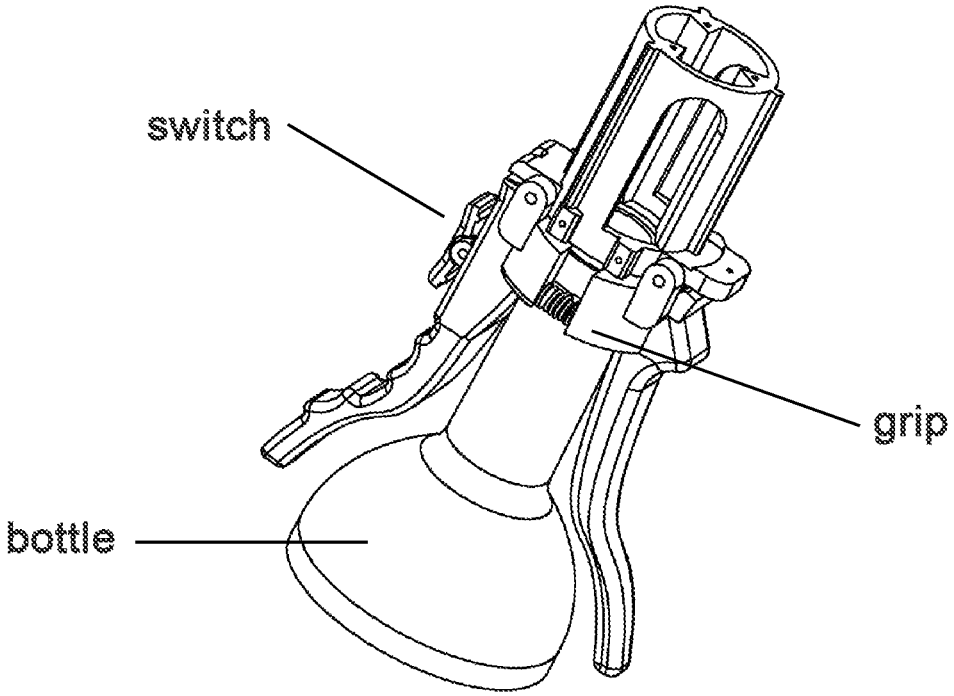
FIG. 9B shows how with the aid of the handles in the opener the bottle of wine can be held with a single hand with access to the switch.

FIG. 9A and FIG. 9B represent isometric views of the handles hinged to the fixed body and gripping the bottle. The springs of which there are two in total keep the handles normally apart. Note that in FIG. 9A one spring has been omitted for clarity. The operating switch is shown and is easily reached by the index finger of the hand grabbing the handles. In addition to the operating switch, the handles have built in grips that grab the bottle and hold the bottle and opener as one piece. The surface that makes contact with the bottle has to have high friction in order that the bottle is held without relative movement between it and the part of the opener to which it is butted against. This is achieved in the prototype by lining the grips with rubber. The bottle is held firmly by placing the opener over the mouth of the bottle and squeezing the handles together such that the grips butt up against the neck of the bottle while the opener sits over the mouth of the bottle. Thus the handles fulfil the purposes of allowing the operator to hold the opener and bottle tightly together and to turn the opener on and off, all with a single hand. Right and left hand operation is allowed by the user holding the opener in opposite sides.

Telescopic Movement and Guides

Figure 10A:
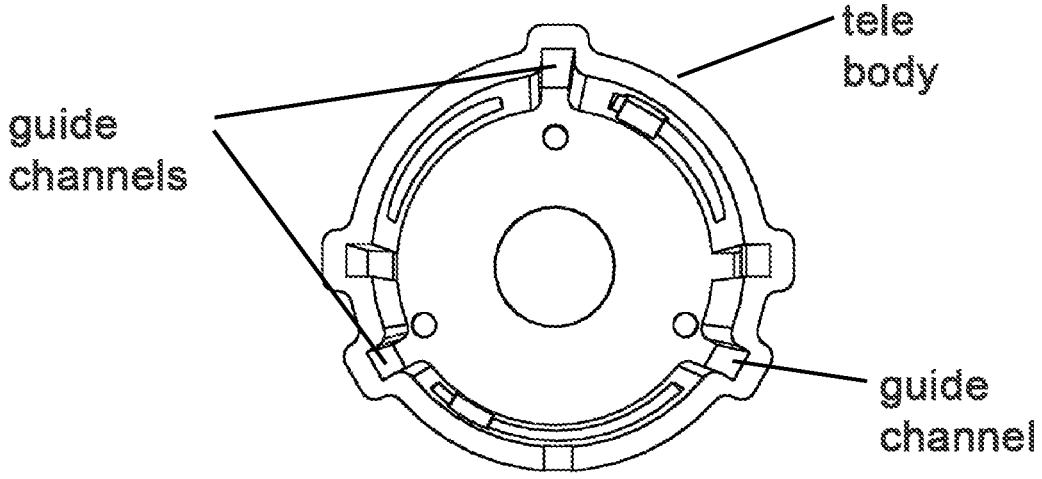
FIG. 10A shows the guide channels in the tele body
Figure 10B:
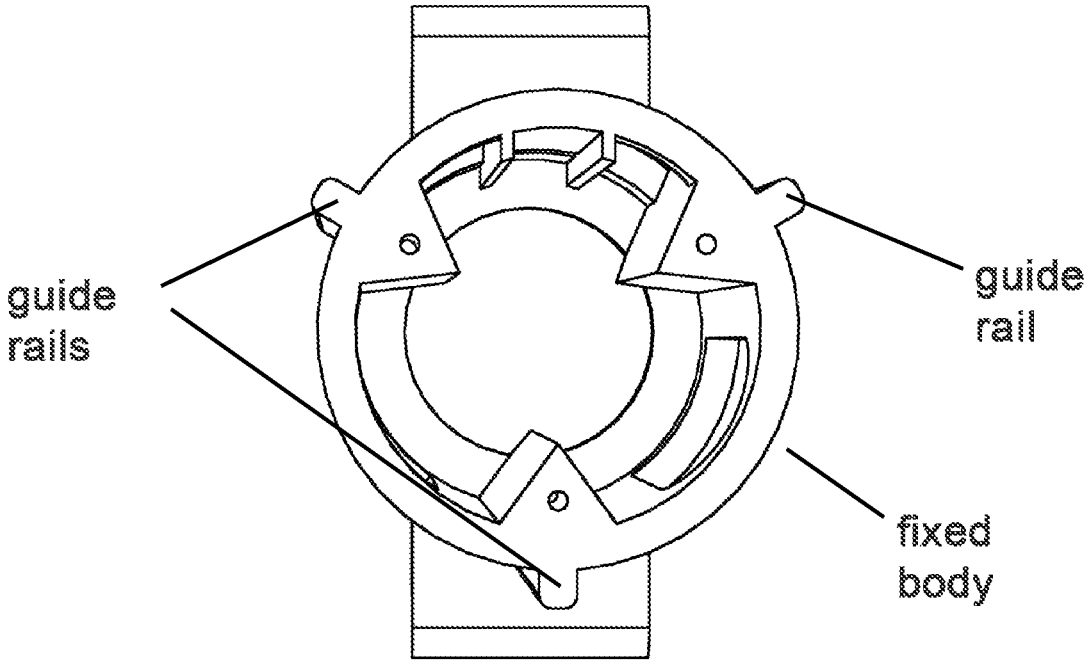
FIG. 10B shows the guide rails in the fixed body.
Figure 10C:
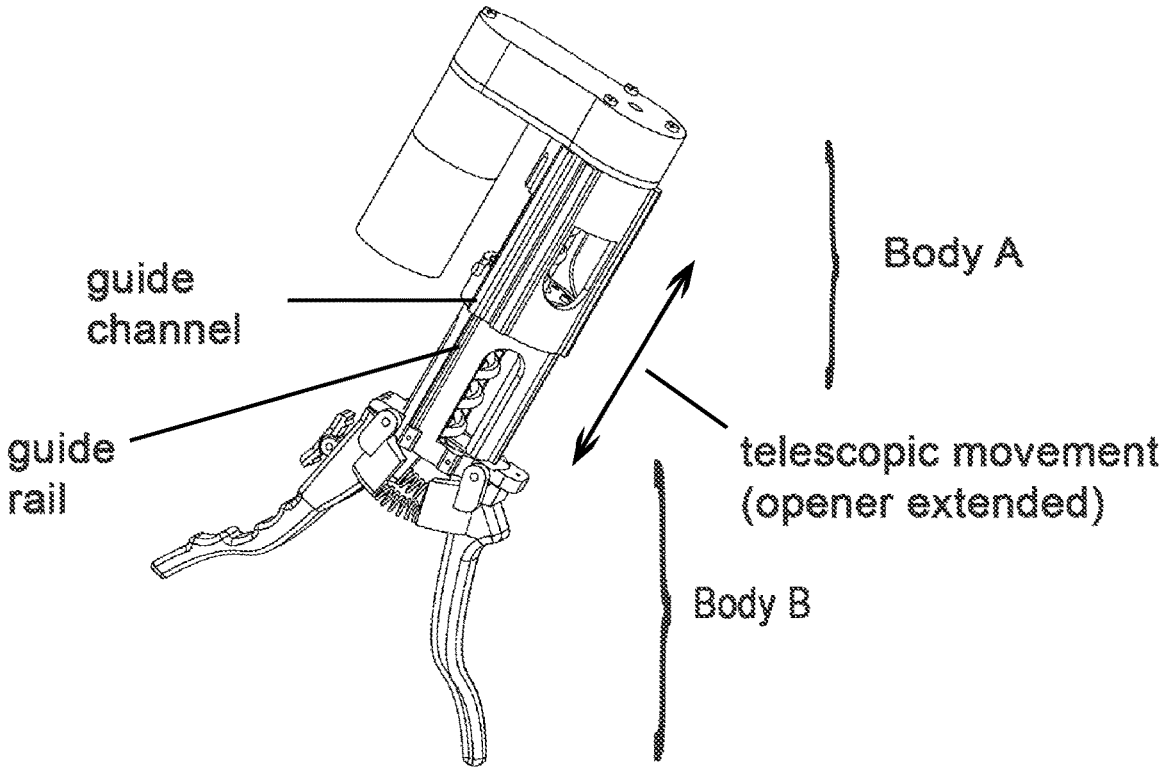
FIG. 10C and FIG. 10D show how the telescopic movement between the tele and fixed bodies makes the opener extend and retract with the guides keeping the two bodies in alignment.
Figure 10D:
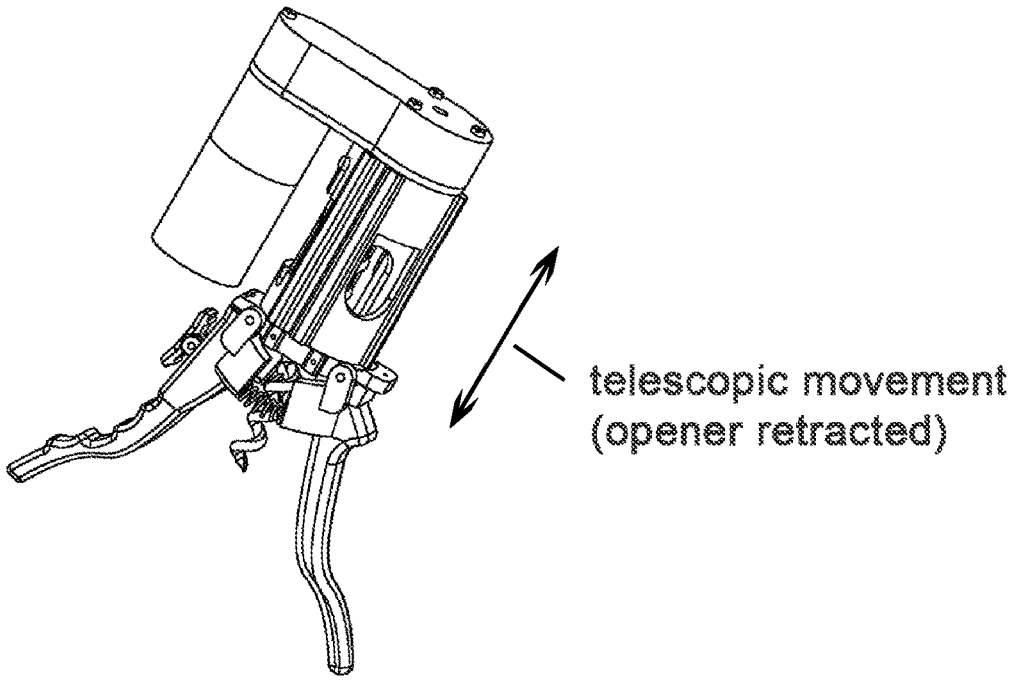

FIGS. 10A and 10B show the guide channels and guide rails on the tele and fixed bodies respectively. The tele body is seen from below whereas the fixed body is viewed from above. FIGS. 10C and 10D show the telescopic movement between these two bodies, with the guides ensuring they stay aligned with no relative rotation between the two.

Motor System and Power Supply

Figure 11A:
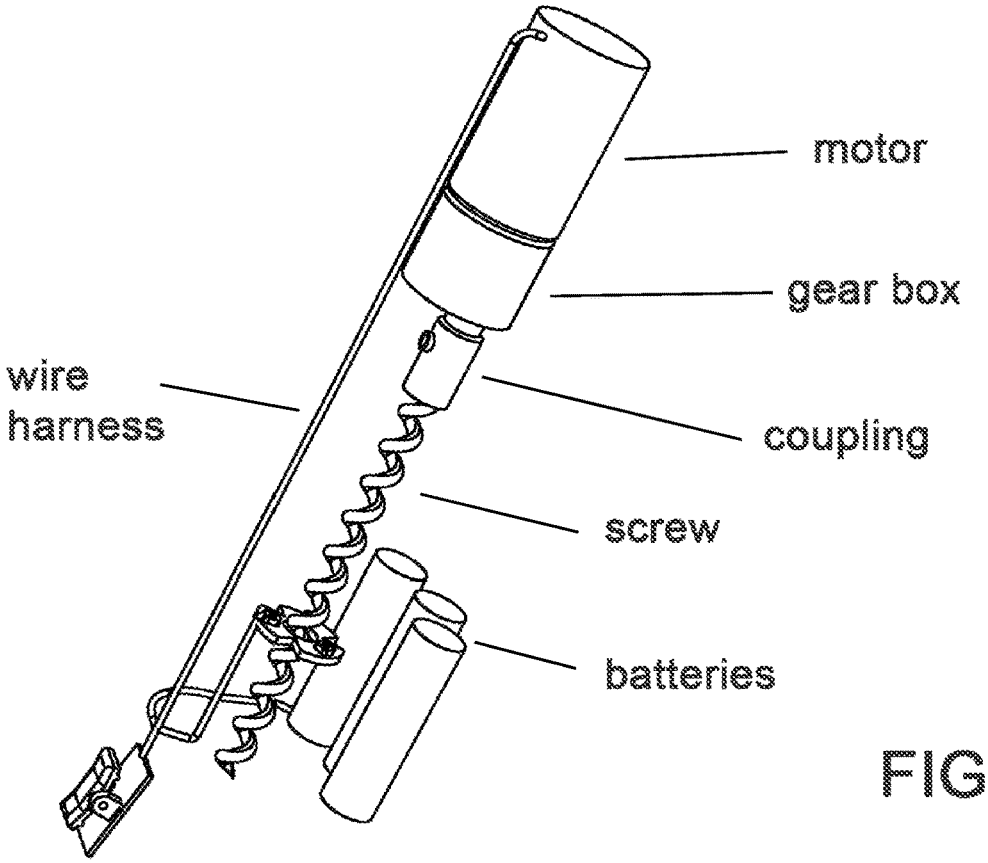
FIG. 11A and FIG. 11B show the motor system, transmission and power supply for the inline and parallel configuration respectively.
Figure 11B:
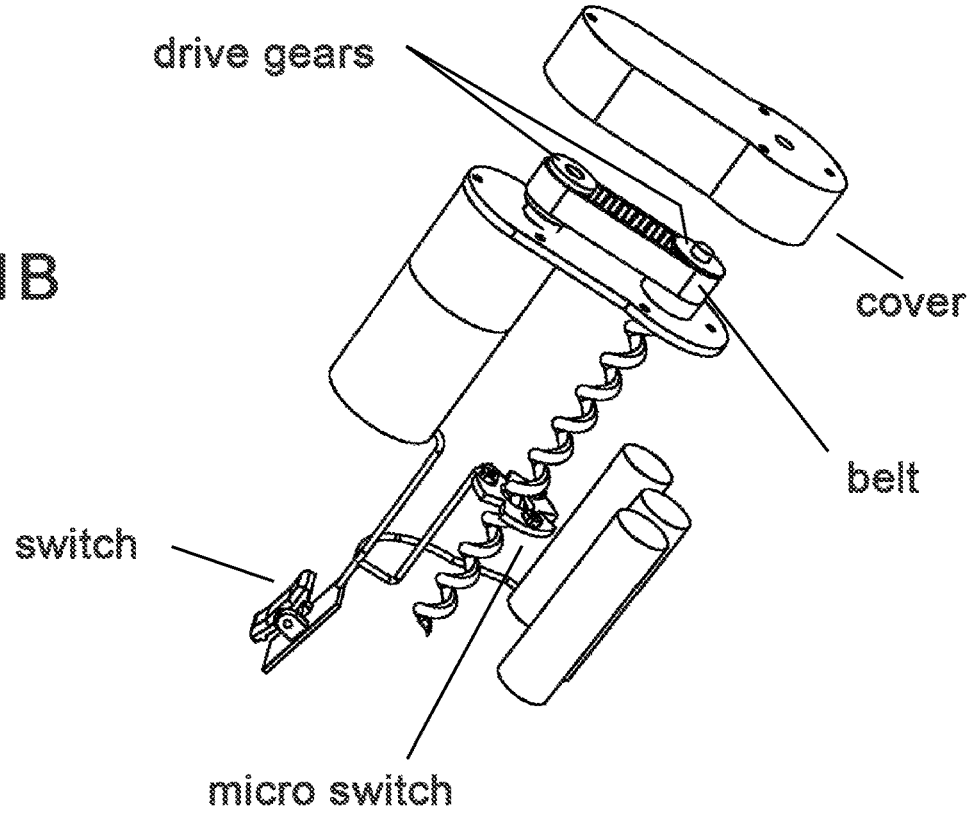

FIGS. 11A and 11B show the motor system and power supply used for the inline and parallel embodiment of the opener respectively. In the inline embodiment the motor system consists of the motor, gear box, and transmission, with a coupling acting as a transmission to the cork screw. In the parallel embodiment on the other hand the transmission is carried out by two drive gears and a belt. The motor is also electrically connected via a wire harness to the switch, micro switch and batteries.

Micro Switch

Figure 12A:
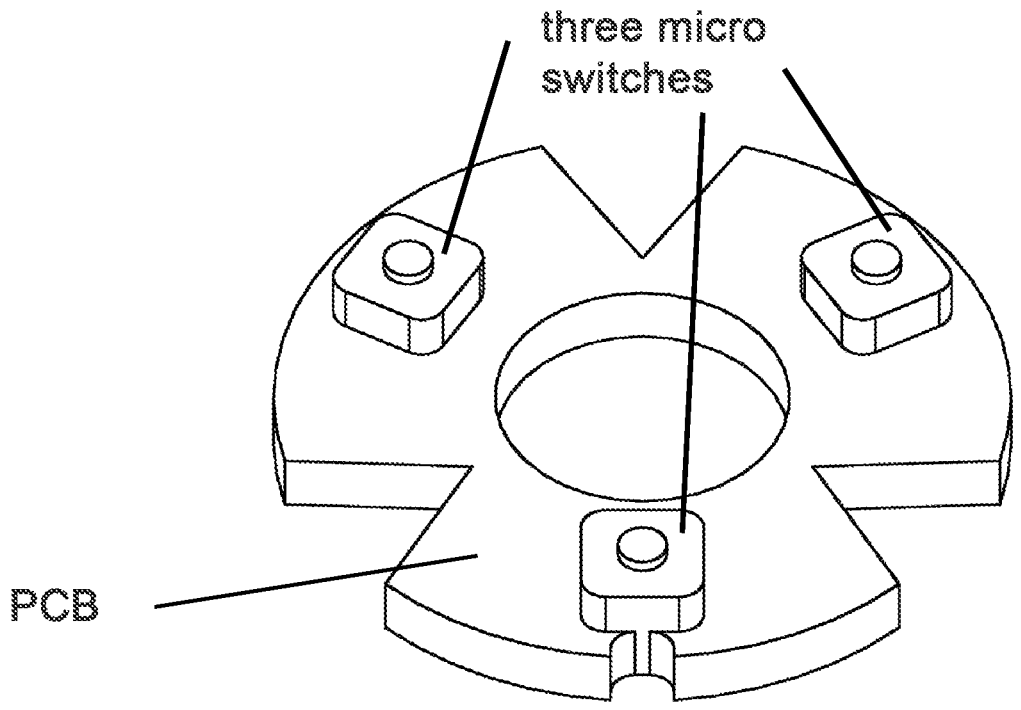
FIG. 12A and FIG. 12B show the micro switch and associated wiring.
Figure 12B:
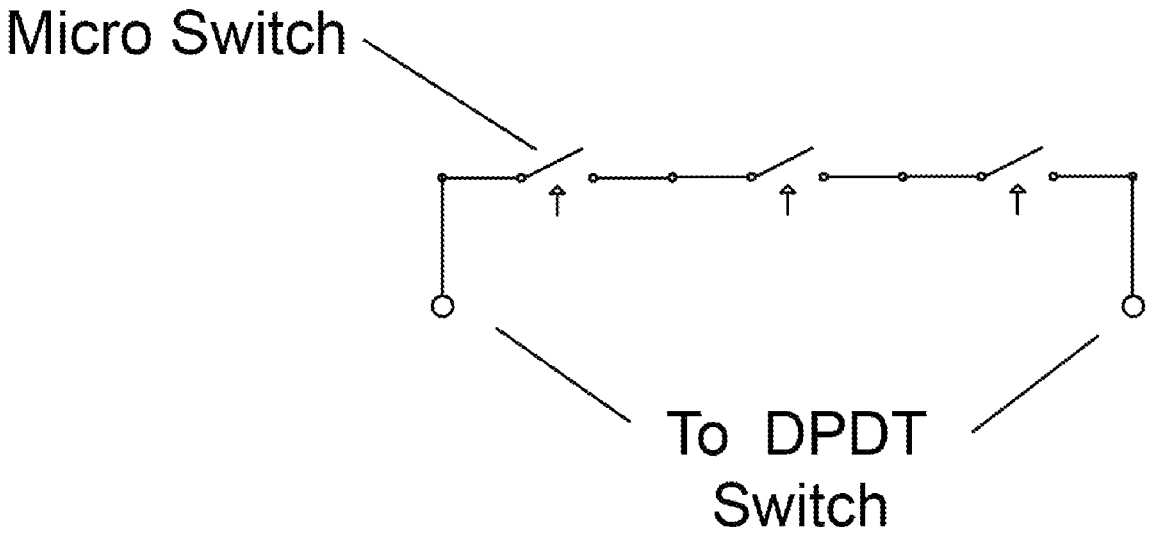

FIG. 12A and FIG. 12B show the micro switch used in the opener prototype. It consists of three individual micro switches wired in series and soldered to a circular printed circuit board, PCB, so that the turn off operation is performed efficiently regardless of the orientation of the cork which does not have a perfectly regular shape by nature. The three micro switches thus form one individual micro switch as a whole. This micro switch is in turn connected via two wires to the DPDT switch.

Electrical Schematic

Figure 13:
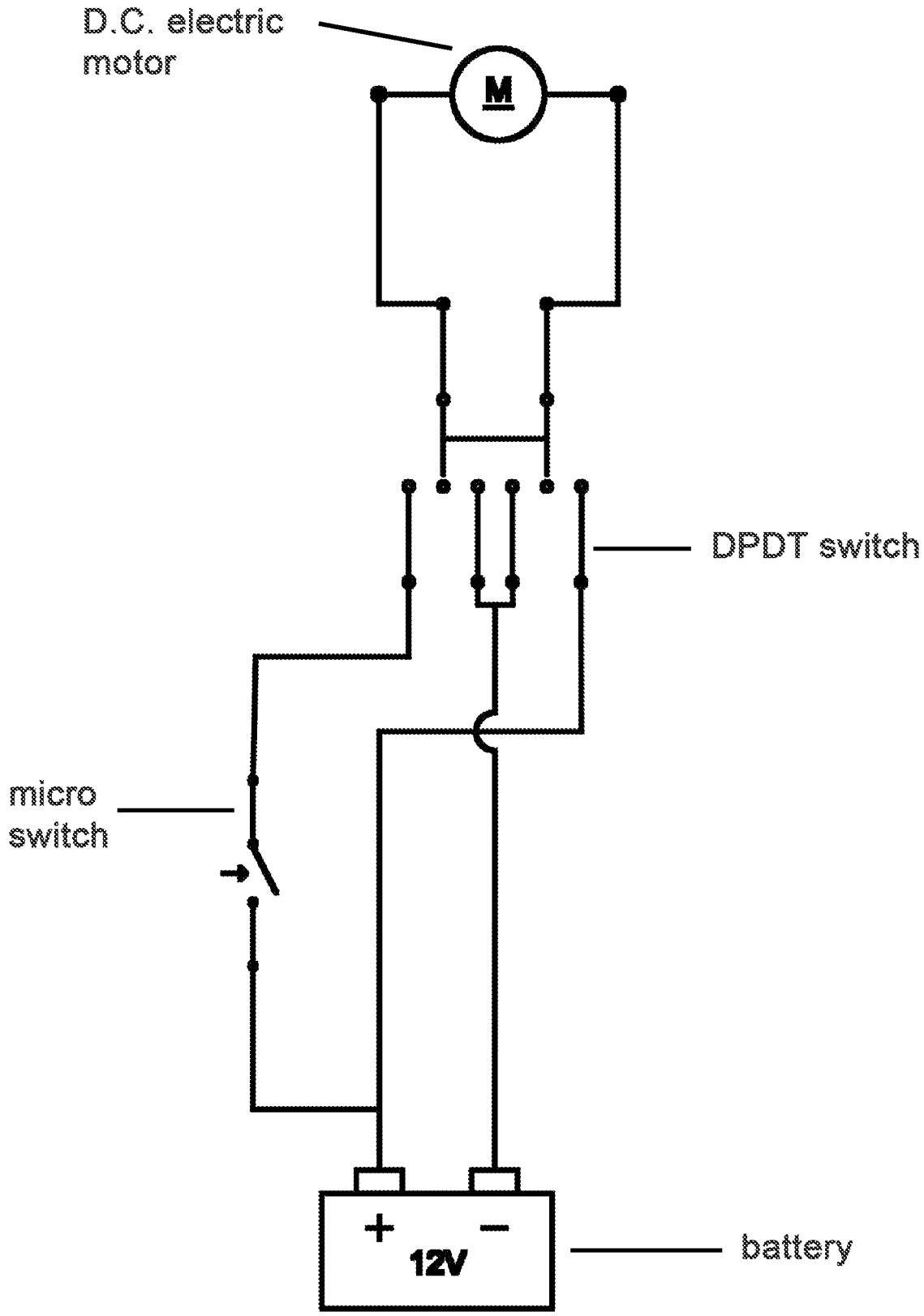
FIG. 13 shows the electrical schematic of the invention.
Figure 14A:
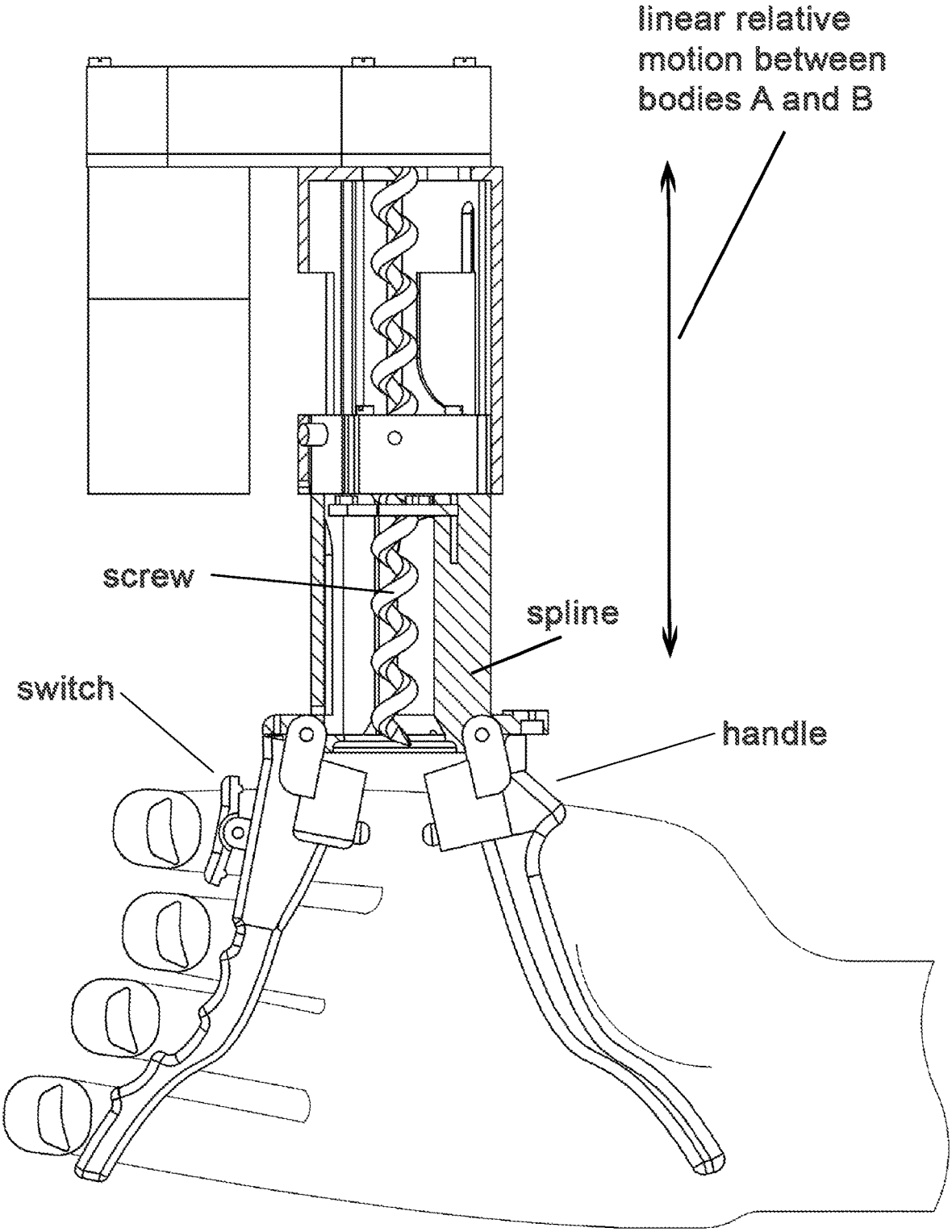
FIG. 14A to FIG. 14G show the complete sequence of operation of the cork remover and ejector.
Figure 14B:
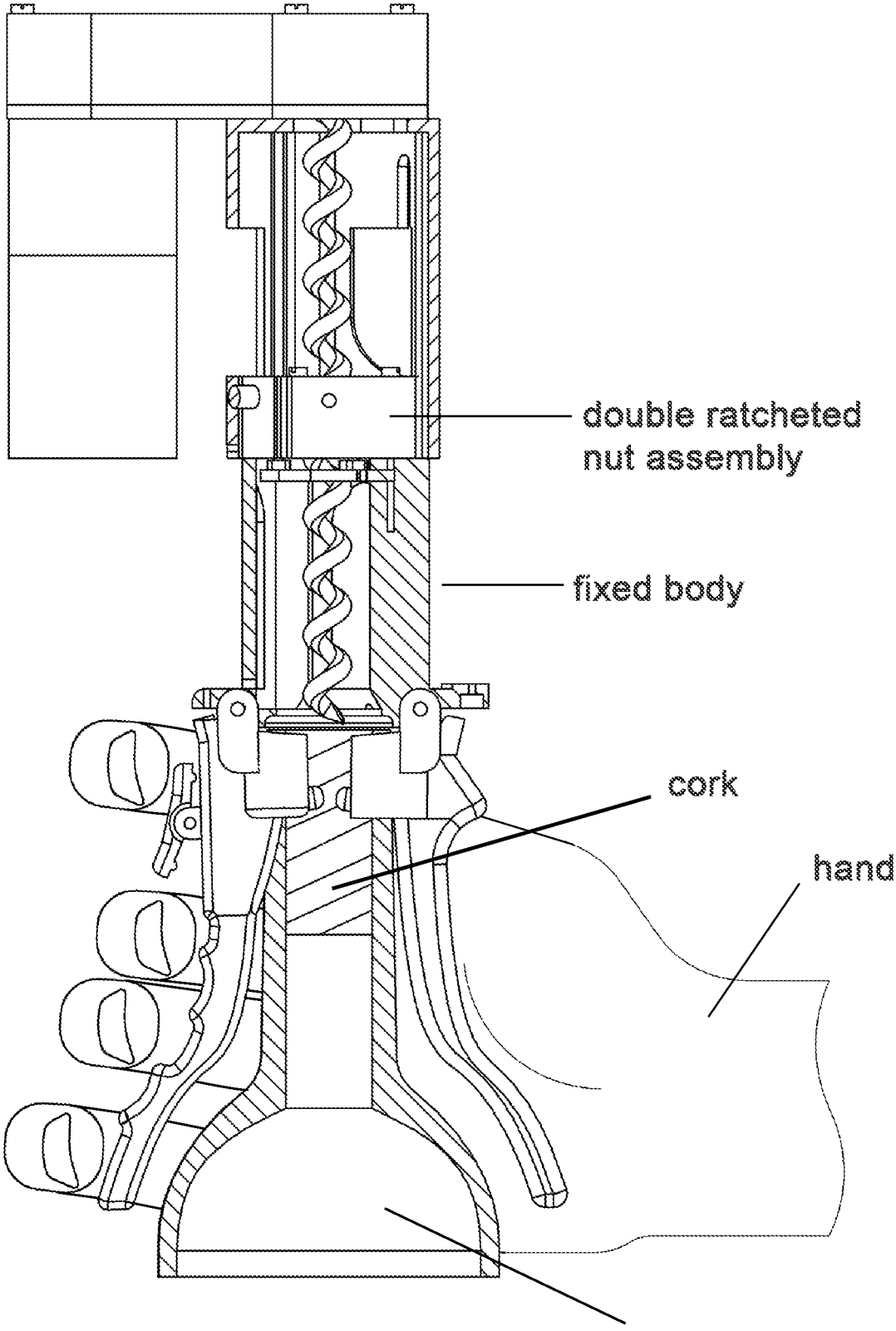
Figure 14C:
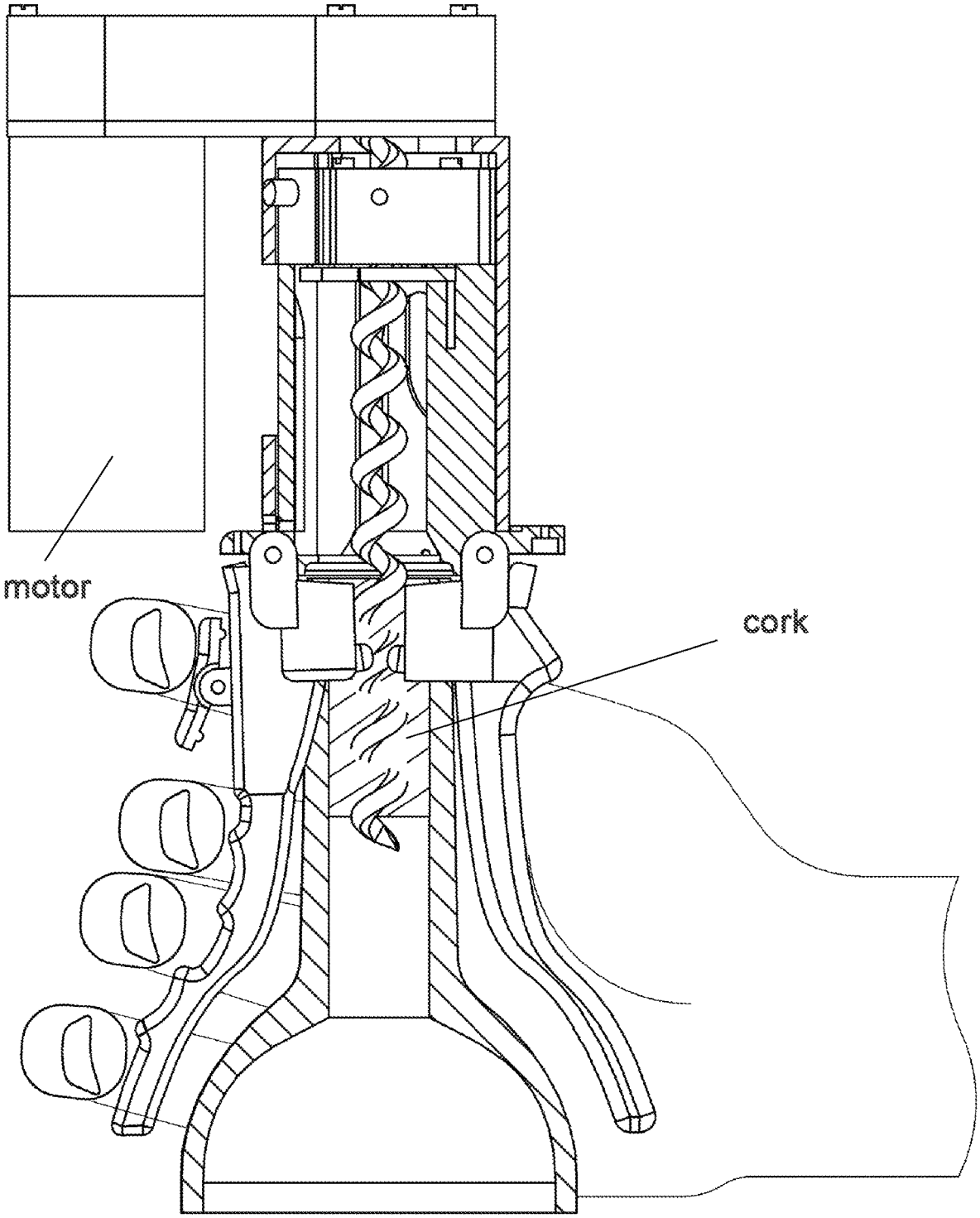
Figure 14D:
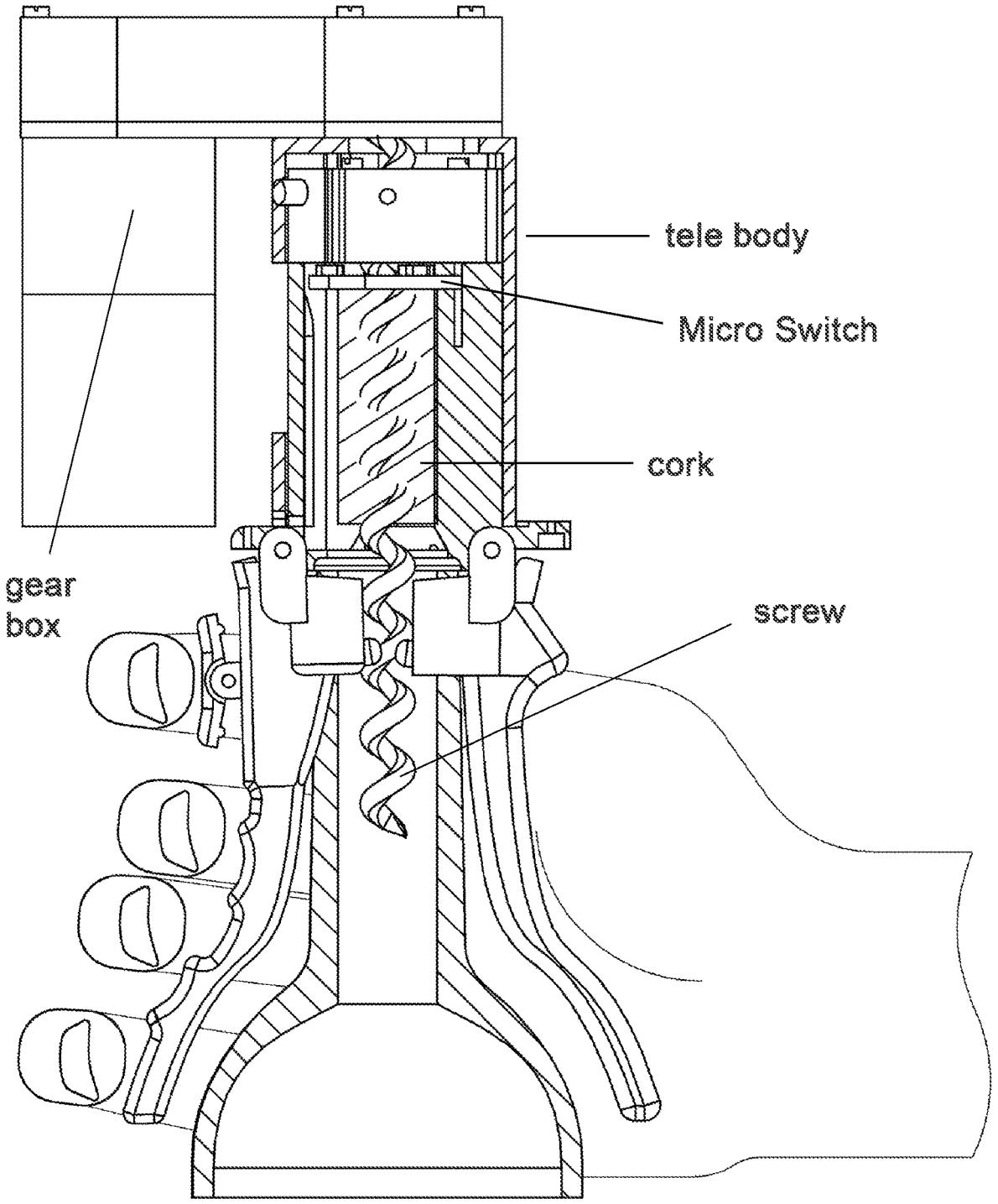
Figure 14E:
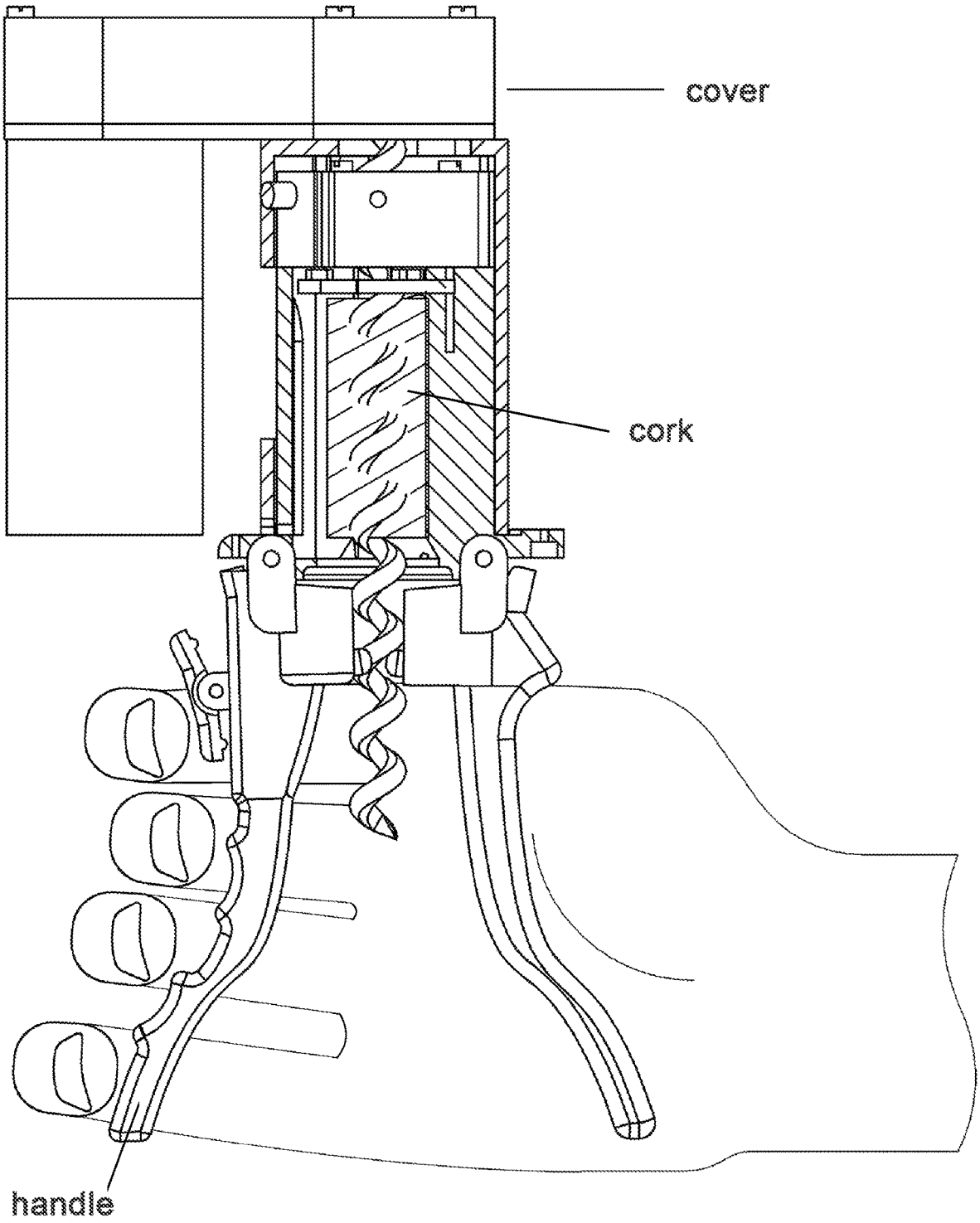
Figure 14F:
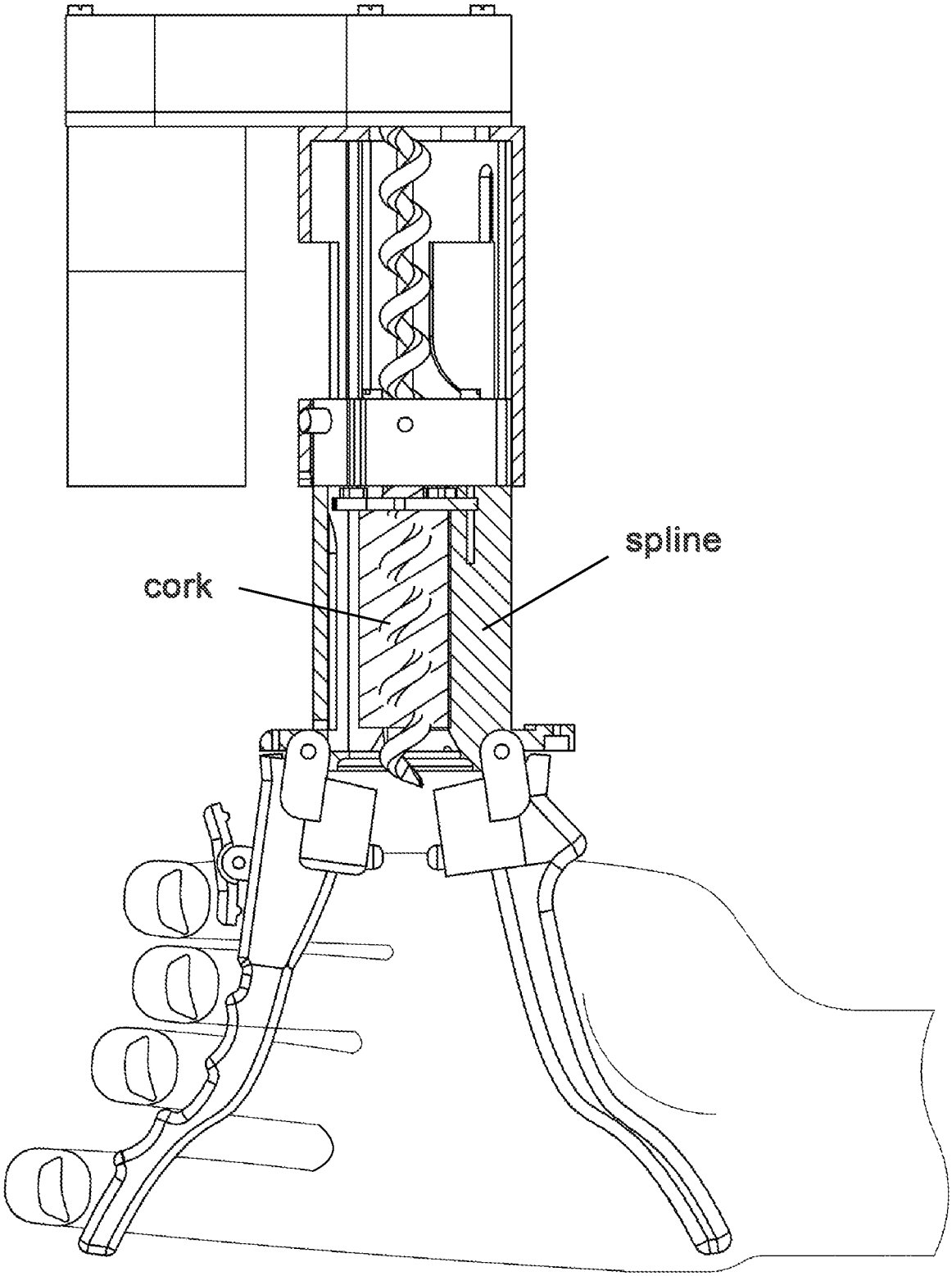
Figure 14G:
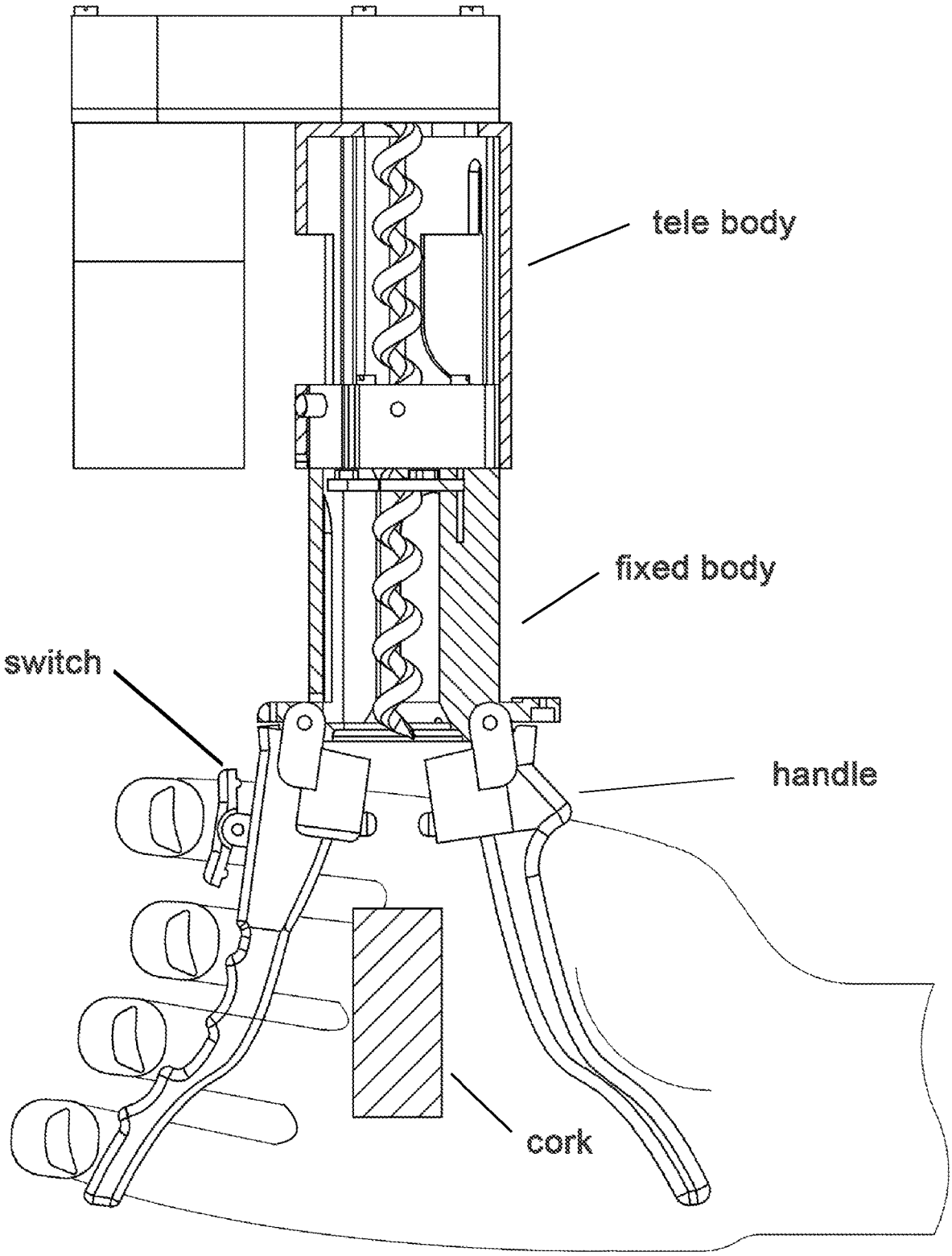

FIG. 13 shows the electrical schematic of the opener. The wire harness connects the motor, DPDT switch, the micro switch, and the nominal 12 volt power which is attained by three Li-Ion in series in the prototype. The micro switch stops rotation of the motor when the cork is extracted as it reaches the end of its upward travel in the extractor. It does not affect the power to the motor if it is going to rotate counter clockwise. The DPDT switch is spring loaded and has three positions and is normally at its center position: two extreme positions for right and left rotation of the motor and a center position where all power to the motor is cut off and the latter is considered to be in its off state. The position of the DPDT switch for clockwise/counter clockwise rotation of the motor is not critical and can be reversed. It depends on the convention adopted. The wire harness consists of five wires from the DPDT switch such that two go to the motor, two go directly to the power supply positive and negative terminals and the fifth wire goes via the micro switch to the battery positive terminal. The motor used in the prototype is a 12v DC motor with a reduction gearbox giving 15 RPM. An alternative is to use a Brushless Direct Current (BLDC) motor which is smaller and lighter than a standard DC motor for the same power, but introduces additional complications since it requires a special controller to control the three phases of the motor. Also in this case, a simple DPDT switch will not do for the operation required.

Operation

See FIGS. 14A to 14G for complete sequence of operation steps for opening a bottle and ejecting the cork from the opener. Note that Tele, Fixed, Cork and Bottle bodies have cut-outs to enable clarity and that with the same aim the handle springs and battery components have been omitted from the figures. The figures display the hand of the user grabbing the opener, but the thumb is not shown since it would obstruct the cork and the view. The cork extractor contains the parts listed in the index of parts. It operates in the following fashion:

Body A slips over body B such that they move relative to each other in telescoping fashion with the stops preventing the two bodies from coming apart. Thus all bodies form one complete unit.

The user holds the cork extractor by the open handles in the extended configuration, where bodies A and B are fully apart, with the handle springs extended, puts it over the mouth and neck of the bottle and squeezes such that the grips hold the bottle by its mouth and neck tightly. In this way the user is holding the opener and bottle together with one hand. With the index finger of the hand holding the opener and bottle the user depresses one end of the DPDT switch, normally the top side, such that the corkscrew turns clockwise and penetrates into the cork. See FIG. 14A and FIG. 14B. The rate of rotation is set by the electric motor and gearbox combination and is normally set to 15 rpm to 60 rpm at 12 volts. At this point the ratcheted nut cannot turn clockwise due to the action of pawl1 which is in the engaged position because pawl1 is not being pushed by pushrod1 which in turn is pushed by the ramp in channel 1, and thus the corkscrew penetrates the cork as it rotates, effortlessly on the part of the user due to the corkscrew screwing itself into the stationary nut. Initially penetration into the cork and retraction of the opener are ensured by this screwing into the nut and subsequently the cork also contributes to this process since it acts as a nut.

When the opener reaches the end of travel i.e. when bodies A and B won't get any closer and the telescoping action has ceased, pawl1 will go to the disengaged position, i.e. ramp1 will push on pawl1 via its pushrod and disengage it from its corresponding ratchet thus allowing the nut to rotate freely in the clockwise direction. See FIG. 14C. The corkscrew continues to rotate with the nut as the cork screws itself further into the corkscrew to which it is already screwed as the former ascends into the opener while being stopped from rotating by the splines, until it slips out of the bottle, thus the cork is removed from the bottle and is wholly embedded in the cork extractor by the time the cork has risen all the way up the fixed body. When at the top of the fixed body the cork hits the micro switch which stops the rotation of the corkscrew in the clockwise direction given that the cork has reached its end of travel. See FIG. 14D.

The user may now remove the opener and the cork from the bottle and the latter is considered open, while the cork is still embedded in the opener. See FIG. 14E.

To eject the cork from the extractor itself the user has simply to reverse the rotation of the corkscrew by depressing the other side of the of the DPDT switch, normally the lower side, where upon the extractor will first go to its fully extended position by the action of the ratcheted nut, which is stopped from rotating counter clockwise because pawl2 is in the engaged position allowing bodies A and B to extend relative to each other, and the corkscrew to partially unscrew itself from the cork. When the opener is fully extended, the cork is still in the fixed body of the opener, and pawl2 disengages from ratchet2, i.e. ramp2 will push on pawl2 via its pushrod and disengage it, and the nut is free to rotate counter clockwise. See FIG. 14F. Continued rotation in the counter clockwise direction of the corkscrew and the nut results in the cork unscrewing itself from the corkscrew and sliding off the sharp splines while at the same time not rotating counter clockwise due to the effect of the splines, until the cork fully ejects itself from the cork extractor. See FIG. 14G.

When the user squeezes the handles such that the bottle is gripped, the grip linings are firmly butted against the bottle providing a friction force that holds the remover and the bottle together. This force and ultimately the hand of the user, counter the torque generated when the cork is being extracted from the bottle as well as the torque arising when ejecting the cork from the bare extractor.

Thus with one hand the user is able to handle all forces generated by the cork extraction/ejection operation and to hold the extractor and bottle together i.e. perform the entire operation single handed.

The invention claimed is:

1. A cork remover and ejector, comprising bodies A and B: wherein body A and body B slip over each other in telescoping fashion; the body A comprises a telescoping body; three guide channels; two actuating channels, channel 1 and channel 2 with built in ramps; an electric motor system; and a corkscrew which is driven by the motor system; the body B comprises: a fixed body; a nut assembly; two pawls; three guide rails; a structure to keep the cork from rotating as it enters and exits the remover; the said structure being part of the fixed body; a battery housing; batteries; two handles with built in grips hinged to the fixed body and having a surface capable of grasping a bottle; a switch on one of the handles; and two springs which keep the two grips normally apart as they embrace a neck of the bottle.

2. The cork remover and ejector of claim 1, wherein the structure comprises three sharp splines which allow the cork to slip along them while at the same preventing rotation of the cork.

3. The cork remover and ejector of claim 1, wherein the motor system further comprises a battery operated DC electric motor; a gearbox; and a transmission to the corkscrew; all three elements are coupled together; the motor can rotate in either direction or remain in the off condition according to user command.

4. The cork remover and ejector of claim 3, wherein the transmission consists of either: two gears and a belt or a sleeve with a setscrew.

5. The cork remover and ejector of claim 1, wherein the cork remover and ejector further comprises a micro switch which turns off the current to the motor as the motor spins in a clockwise direction when the cork reaches its upward travel limit, while still allowing the motor to rotate in the counter clockwise direction; the said micro switch prevents binding of the cork remover and ejector due to the presence of the cork and a wrongly pressed operation switch.

6. A cork remover and ejector, cork remover and ejector comprising: a nut assembly including a nut with two built in ratchets, positioned on top of each other and axially aligned, and arranged to function in opposite directions; a corkscrew; two pawls; two bodies A and B that move in telescoping fashion relative to each other; and two actuating channels built into the body A; wherein the nut assembly which is attached to the body B moves the two bodies telescopically as the removal and the ejection operations are performed and ensures that the corkscrew penetrates the cork, while the ratchets forming part of the nut prevent the two bodies from binding as their end of travel is reached; wherein the nut assembly further comprises: a nut housing with a lid and screws; two stops so that the bodies A and B don't come apart; the said nut with built in ratchets; the said two pawls which engage with their corresponding ratchet; two pawl pushrods which push on the pawls to make the pawls disengage the ratchets; two pawl springs that make the pawls return to their fully engaged position when the pawl pushrods allow; and two pawl pins which hold the pawls and allow them to rotate.

7. The cork remover and ejector in claim 6, wherein the bodies A and B can move telescopically relative to each other, allowing the opener to shorten/lengthen itself a distance equivalent to the length the cork at least, as it retracts and extends the opener when the removal and extraction operations are performed.

8. The cork remover and ejector in claim 6, wherein ramps are built into the actuation channels to enable the pushing action on the pushrods which allows the disengagement of the pawls.

* * * * *